US007471276B2

(12) United States Patent
Tomohara

(10) Patent No.: US 7,471,276 B2
(45) **Date of Patent: *Dec. 30, 2008**

(54) DISPLAY CONTROLLER, DISPLAY SYSTEM, AND DISPLAY CONTROL METHOD

(75) Inventor: Kiyohide Tomohara, Hino (JP)

(73) Assignee: Seiko Epson Corporation (JP)

( * ) Notice: Subject to any disclaimer, the term of this patent is extended or adjusted under 35 U.S.C. 154(b) by 569 days.

This patent is subject to a terminal disclaimer.

(21) Appl. No.: 11/043,030

(22) Filed: Jan. 25, 2005

(65) Prior Publication Data

US 2005/0190127 A1 Sep. 1, 2005

(30) Foreign Application Priority Data

Jan. 26, 2004 (JP) ..... 2004-017309

(51) Int. Cl.
*G09G 3/36* (2006.01)
*G09G 3/30* (2006.01)

(52) U.S. Cl. ..... 345/98; 345/76; 345/77; 345/213

(58) Field of Classification Search ..... 345/76–104, 345/204, 213, 212, 690–693; 315/169.3
See application file for complete search history.

(56) References Cited

U.S. PATENT DOCUMENTS

| | | | | |
|---|---|---|---|---|
| 6,366,026 | B1 * | 4/2002 | Saito et al. | 315/169.3 |
| 6,906,706 | B2 * | 6/2005 | Kosaka et al. | 345/211 |
| 2004/0263540 | A1 * | 12/2004 | Ooishi et al. | 345/690 |

FOREIGN PATENT DOCUMENTS

| | | |
|---|---|---|
| JP | 08-095531 | 4/1996 |
| JP | 10-023359 | 1/1998 |
| JP | 11-73159 | 3/1999 |
| JP | 11-109921 | 4/1999 |
| JP | 2001-350452 | 12/2001 |
| JP | 2003-15613 | 1/2003 |
| JP | 2003-44015 | 2/2003 |

* cited by examiner

*Primary Examiner*—Jimmy H Nguyen
(74) *Attorney, Agent, or Firm*—Harness, Dickey & Pierce, P.L.C.

(57) ABSTRACT

A display controller including: a latch pulse signal generation section which generates first and second latch pulse signals having pulses which specify one horizontal scan period; and an offset period setting register in which a phase difference between the first and second latch pulse signals is set. The second latch pulse signal changes earlier than the first latch pulse signal by a period corresponding to the phase difference set in the offset period setting register. The display controller outputs the first and second latch pulse signals respectively to first and second data drivers which store display data for one horizontal scan period based on the first and second latch pulse signals.

11 Claims, 33 Drawing Sheets

540
DISPLAY CONTROLLER
GCLKRA~GCLKBA
GCLKRB~GCLKBB
DIS1A
DIS1B
LPA
LPB
D
DCLK
YD
520A
FIRST DATA DRIVER
D0
DCLK0
520B
SECOND DATA DRIVER
DL1
DLx
DL(x+1)
DL(2x)
GL1
GLy
GL(y+1)
GL(2y)
FIRST SCAN DRIVER
SECOND SCAN DRIVER
YD0
LP0
530A
DIS2A
DIS2B
530B

FIG.20A

| XRST | CLK | XCLR | LD | E | LOAD VALUE | CURRENT | NEXT | NOTE |
|---|---|---|---|---|---|---|---|---|
| 0 | — | — | — | — | — | — | 6 | RESET |
| 1 | ↑ | 0 | — | — | — | — | 6 | INITIAL VALUE LOAD |
| 1 | ↑ | 1 | 1 | — | HT | HCNT | HT | SET VALUE LOAD |
| 1 | ↑ | 1 | 0 | 1 | HT | HCNT | HCNT-1 | COUNTDOWN |
| 1 | ↑ | 1 | 0 | 0 | HT | HCNT | HCNT | HOLD |
| OTHER CONDITIONS | | | | | HT | HCNT | HCNT | HOLD |

FIG.20B

| XRST | CLK | XCLR | LD | E | LOAD VALUE | CURRENT | NEXT | NOTE |
|---|---|---|---|---|---|---|---|---|
| 0 | — | — | — | — | — | — | 0 | RESET |
| 1 | ↑ | 0 | — | — | — | — | 0 | INITIAL VALUE LOAD |
| 1 | ↑ | 1 | 1 | — | SIZY | VCNT | SIZY | SET VALUE LOAD |
| 1 | ↑ | 1 | 0 | 1 | SIZY | VCNT | VCNT-1 | COUNTDOWN |
| 1 | ↑ | 1 | 0 | 0 | SIZY | VCNT | VCNT | HOLD |
| OTHER CONDITIONS | | | | | SIZY | VCNT | VCNT | HOLD |

FIG.20C

| SIGNAL NAME | CONDITION |
|---|---|
| HCNT_E | DCLK_EB=1 |
| HCNTLD | HCNT=0 AND DCLK_EB=1 |
| VCNTLD | VCNT=0 AND HCNT=0 AND DCLK_EB=1 |

FIG.24A

| XRESET | CLK | PINFENB | DCLK_EB | HCNT | DM | NOTE |
|---|---|---|---|---|---|---|
| 0 | — | — | — | — | 0 | RESET |
| 1 | ↑ | 0 | — | — | 0 | INITIAL VALUE LOAD |
| 1 | ↑ | 1 | 1 | HCNT=1 | 1 | DCLK MASK CANCELLATION |
| OTHER CONDITIONS | | | | | HOLD | HOLD |

FIG.24B

| XRESET | CLK | PINFENB | DCLK_EB | DM | LPM | NOTE |
|---|---|---|---|---|---|---|
| 0 | — | — | — | — | 0 | RESET |
| 1 | ↑ | 0 | — | — | 0 | INITIAL VALUE LOAD |
| 1 | ↑ | 1 | 1 | 1 | 1 | LP MASK CANCELLATION |
| OTHER CONDITIONS | | | | — | HOLD | HOLD |

FIG.24C

| SIGNAL NAME | CONDITION |
|---|---|
| dec_lpa | HCNT=0 AND LPM=0 |
| dec_lpb | HCNT≦OFFSET AND LPM=0 |
| dec_yd | HCNT≦IDLTIM AND VCNT=SIZY |

FIG.27

| SIGNAL NAME | CONDITION |
|---|---|
| DIS1A_LTRG | HCNT=HT−DIS1A |
| DIS1B_LTRG | HCNT=HT−DIS1B |
| DIS2A_LTRG | HCNT=HT−DIS2A |
| DIS2B_LTRG | HCNT=HT−DIS2B |
| DIS1A_HTRG | HCNT=1+OFFSET |
| DIS1B_HTRG | HCNT=1+OFFSET×2 |
| DIS2A_HTRG | HCNT=1 |
| DIS2B_HTRG | HCNT=1+OFFSET |

FIG.32A

| XRST | CLK | XCLR | LD | E | LOAD VALUE | CURRENT | NEXT | NOTE |
|---|---|---|---|---|---|---|---|---|
| 0 | — | — | — | — | — | — | 0 | RESET |
| 1 | ↑ | 0 | — | — | — | — | 0 | COUNT STOP |
| 1 | ↑ | 1 | 1 | — | G | GCNT1 | G | SET VALUE LOAD |
| 1 | ↑ | 1 | 0 | 1 | G | GCNT1>0 | GCNT1-1 | COUNTDOWN |
| 1 | ↑ | 1 | 0 | 0 | G | GCNT1 | GCNT1 | HOLD |
| OTHER CONDITIONS | | | | | G | GCNT1 | GCNT1 | HOLD |

FIG.32B

| XRST | CLK | XCLR | LD | E | LOAD VALUE | CURRENT | NEXT | NOTE |
|---|---|---|---|---|---|---|---|---|
| 0 | — | — | — | — | — | — | 15 | RESET |
| 1 | ↑ | 0 | — | — | — | — | 15 | INITIAL VALUE LOAD |
| 1 | ↑ | 1 | 1 | — | LDVALUE | GCNT2 | LDVALUE | SET VALUE LOAD |
| 1 | ↑ | 1 | 0 | 1 | LDVALUE | GCNT2<15 | GCNT2+1 | COUNTUP |
| 1 | ↑ | 1 | 0 | 0 | LDVALUE | GCNT2 | GCNT2 | HOLD |
| OTHER CONDITIONS | | | | | LDVALUE | GCNT2 | GCNT2 | HOLD |

FIG.32C

| SIGNAL NAME | CONDITION |
|---|---|
| GCNT1LD | (CNTSTART=1 OR (GCNT2≠15 AND GCNT1=0)) AND ENB=1 |
| GCNT1_E | GCNT2≠15 AND ENB=1 |
| GCNT2LD | (CNTSTART=1 OR (GCNT1=0 AND G=0)) AND ENB=1 |
| PREGCLK | GCNT1=1 |

DISPLAY CONTROLLER, DISPLAY SYSTEM, AND DISPLAY CONTROL METHOD

Japanese Patent Application No. 2004-17309, filed on Jan. 26, 2004, is hereby incorporated by reference in its entirety.

BACKGROUND OF THE INVENTION

The present invention relates to a display controller, a display system, and a display control method.

In recent years, a display device using an electroluminescent (EL) element has attracted attention. In particular, since an organic EL panel including an EL element formed using a thin film of an organic material is a self-emission type, a backlight becomes unnecessary, whereby a wide viewing angle is implemented. Moreover, since the organic EL panel has a high response speed in comparison with a liquid crystal panel, a color video display can be easily implemented by simple configuration.

The organic EL panel is divided into a simple matrix type and an active matrix type in the same manner as the liquid crystal panel. When driving a simple matrix type organic EL panel, grayscale control may be performed using pulse width modulation (hereinafter abbreviated as "PWM"). A display controller performs grayscale control by outputting control signals to drivers (data driver and scan driver) which drive the organic EL panel.

The data lines of the organic EL panel may be driven using a plurality of data drivers. The data drivers are cascade-connected. Display data and various synchronization signals are supplied to the cascade-connected data drivers from the display controller. The data driver latches the display data in synchronization with the synchronization signal from the display controller, and supplies drive signals corresponding to the latched display data to the data lines.

However, if the data drivers perform a switch operation of several hundreds of bits of display data at the same time, a peak current is increased due to an increase in shoot-through current or the like. This may cause the power supply voltage of the data drivers to be decreased.

In a liquid crystal display panel, since a liquid crystal element which makes up the liquid crystal display panel has a low response speed, the effect caused by a decrease in power supply voltage rarely influences the display quality of the panel. However, since the organic EL element has a high response speed, the display quality of the organic EL panel may be affected by a decrease in power supply voltage of the data drivers.

In order to prevent such a decrease in power supply voltage, it is effective to make the peak current generation timings of the data drivers different from each other. The generation timings may be made different from each other by delaying the synchronization signal from the display controller by using a buffer circuit or the like. However, the adjustment target timing differs depending on the type of organic EL panel, compatibility between the data driver and the organic EL panel, manufacturing variation, and the like. In particular, since the organic EL element has a high response speed, the display quality deteriorates even if the adjustment target timing differs to only a small extent. This makes it necessary to adjust the timing for each product, thereby causing problems such as an increase in the number of parts accompanying adjustment, an increase in design cost, and an increase in the number of development steps.

In the case of driving the scan lines of the organic EL panel using a plurality of scan drivers, the display quality of the organic EL panel may be affected when the scan drivers perform the switch operation at the same time. The above-described problem occurs not only in the case of driving the organic EL panel, but also in the case of driving a display panel including other display elements having a high response speed.

BRIEF SUMMARY OF THE INVENTION

According to a first aspect of the present invention, there is provided a display controller used for controlling first and second data drivers which drive a plurality of data lines of a display panel, the display panel also having a plurality of scan lines in addition to the data lines, and the display controller comprising:

a latch pulse signal generation section which generates first and second latch pulse signals having pulses which specify one horizontal scan period; and an offset period setting register in which a phase difference between the first and second latch pulse signals is set, wherein the second latch pulse signal changes earlier than the first latch pulse signal by a period corresponding to the phase difference set in the offset period setting register; and wherein the display controller outputs the first and second latch pulse signals respectively to the first and second data drivers which store display data for one horizontal scan period based on the first and second latch pulse signals.

According to a second aspect of the present invention, there is provided a display system, comprising:

a display panel which includes: a plurality of scan lines; a plurality of data lines; and a plurality of electroluminescent elements, each of the electroluminescent elements including one of the scan lines and one of the data lines;

a scan driver which scans the scan lines;

first and second data drivers which drive the data lines; and the above-described display controller, wherein the display controller outputs the first and second latch pulse signals respectively to the first and second data drivers which store the display data for one horizontal scan period based on the first and second latch pulse signals.

According to a third aspect of the present invention, there is provided a display system, comprising:

a display panel which includes: a plurality of scan lines; a plurality of data lines; and a plurality of electroluminescent elements, each of the electroluminescent elements including one of the scan lines and one of the data lines;

first and second scan drivers which scan the scan lines;

first and second data drivers which drive the data lines; and the display controller, wherein the display controller outputs the first and second horizontal blanking adjustment signals respectively to the first and second data drivers, and outputs the first and second vertical blanking adjustment signals respectively to the first and second scan drivers; and wherein the electroluminescent elements are discharged based on the first and second horizontal blanking adjustment signals and the first and second vertical blanking adjustment signals.

According to a fourth aspect of the present invention, there is provided a display control method for controlling first and second data drivers which drive a plurality of data lines of a display panel, the display panel including a plurality of scan lines in addition to the data lines, and the display control method comprising:

generating first and second latch pulse signals having pulses which specify one horizontal scan period, the second latch pulse signal changing earlier than the first latch pulse signal by a period corresponding to a phase difference between the first and second latch pulse signals, the phase difference being set in an offset period setting register; and outputting the first and second latch pulse signals respectively to the first and second data drivers which store display data for one horizontal scan period based on the first and second latch pulse signals.

BRIEF DESCRIPTION OF THE SEVERAL VIEWS OF THE DRAWING

FIG. 20A shows a truth table for illustrating an operation of an HCNT counter; FIG. 20B shows a truth table for illustrating an operation of a VCNT counter; and FIG. 20C shows a truth table for illustrating an operation of the decoder shown in FIG. 19.

FIG. 24A shows a truth table for illustrating an operation of the DCLK mask generation circuit in FIG. 23; FIG. 24B shows a truth table for illustrating an operation of the LP mask generation circuit in FIG. 23; and FIG. 24C shows a truth table for illustrating an operation of the decoder in FIG. 23.

FIG. 27 shows a truth table for illustrating an operation of a trigger generation circuit shown in FIG. 26.

FIG. 32A shows a truth table of an operation of the pulse width counter in FIG. 31, FIG. 32B shows a truth table of an operation of the grayscale counter in FIG. 31; and FIG. 32C shows a truth table of an operation of the decoder in FIG. 31.

DETAILED DESCRIPTION OF THE EMBODIMENTS

Figure 1:
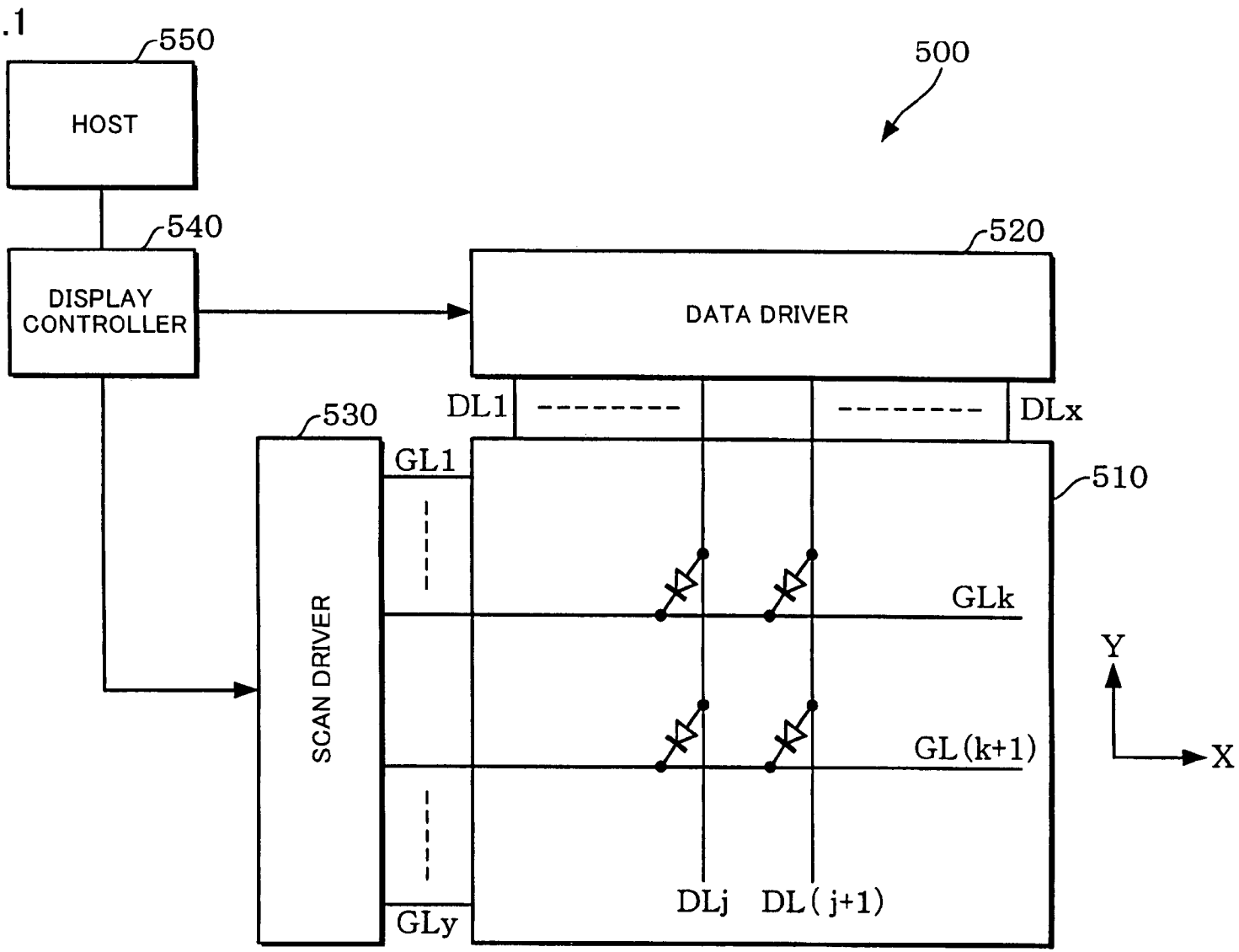
FIG. 1 is a block diagram showing a display system according to one embodiment of the present invention.

The following embodiments of the present invention has been achieved in view of the above-described technical problem, and these embodiments may provide a display controller, a display system, and a display control method which control a plurality of drivers without causing the display quality to deteriorate.

According to one embodiment of the present invention, there is provided a display controller used for controlling first and second data drivers which drive a plurality of data lines of a display panel, the display panel also having a plurality of scan lines in addition to the data lines, and the display controller comprising:

a latch pulse signal generation section which generates first and second latch pulse signals having pulses which specify one horizontal scan period; and an offset period setting register in which a phase difference between the first and second latch pulse signals is set, wherein the second latch pulse signal changes earlier than the first latch pulse signal by a period corresponding to the phase difference set in the offset period setting register; and wherein the display controller outputs the first and second latch pulse signals respectively to the first and second data drivers which store display data for one horizontal scan period based on the first and second latch pulse signals.

In this embodiment, the display controller can output a plurality of latch pulse signals. The display controller can provide the phase difference between the change timings of the latch pulse signals, and can adjust the phase difference. The latch pulse signals are respectively supplied to a plurality of cascade-connected data drivers. Each data driver latches grayscale data in synchronization with the latch pulse signal from the display controller, and supplies a drive signal corresponding to the latched grayscale data to the data lines. Therefore, even if each of the data drivers latches the grayscale data (performs the switch operation) in synchronization with the latch pulse signal supplied thereto, since the peak current generation timings are made different from each other, a decrease in power supply voltage of the data drivers is equalized, whereby the level of a decrease in voltage can be reduced.

This prevents the display quality of the display panel including display elements having a fast response speed such as organic EL elements from being affected by the decrease in power supply voltage of the data drivers. Moreover, since the display controller can adjust the output timings of the latch pulse signals, the peak current generation timings of the data drivers can be precisely made different from each other with high accuracy. Therefore, the timing which differs depending on the type of display panel, compatibility between the data driver and the display panel, manufacturing variation, and the like can be precisely adjusted with high accuracy, whereby the number of parts accompanying adjustment, design cost, and the number of development steps can be reduced.

The display controller may further comprise:

a blanking adjustment signal generation section which generates first and second horizontal blanking adjustment signals respectively used for setting first and second horizontal blanking periods in which the first and second latch pulse signals having the pulses which specify one horizontal scan period are respectively output; and a grayscale clock signal generation section which generates first and second grayscale clock signals, each of the first and second grayscale clock signals having first to Nth grayscale pulses (N is an integer greater than one) in a predetermined period, wherein the second horizontal blanking adjustment signal may change earlier than the first horizontal blanking adjustment signal by a period corresponding to the phase difference set in the offset period setting register;

wherein the display controller may output the first horizontal blanking adjustment signal and the first grayscale clock signal to the first data driver which drives the data lines by using a signal pulse-width-modulated based on the first horizontal blanking adjustment signal and the first grayscale clock signal; and wherein the display controller may output the second horizontal blanking adjustment signal and the second grayscale clock signal to the second data driver which drives the data lines by using a signal pulse-width-modulated based on the second horizontal blanking adjustment signal and the second grayscale clock signal.

In this embodiment, in the case of performing grayscale control by PWM in a horizontal display period specified by the first and second horizontal blanking adjustment signals, the display controller outputs the first and second horizontal blanking adjustment signals while making the output timings of the first and second horizontal blanking adjustment signals different from each other by a period corresponding to the phase difference set in the offset period setting register. This enables to easily prevent the simultaneous generation of the peak currents due to the simultaneous changes of the first and second horizontal blanking adjustment signals. Moreover, fine timing adjustment can be implemented without changing image quality in a display region of the display panel in which data lines are driven by the first data driver to which the first horizontal blanking adjustment signal is supplied and in a display region of the display panel in which data lines are driven by the second data driver to which the second horizontal blanking adjustment signal is supplied.

The display controller may further comprise a grayscale pulse setting register used for setting edges of the first to Nth grayscale pulses of the first grayscale clock signal, wherein an interval between a change timing of the first horizontal blanking adjustment signal and an edge of the first grayscale pulse, and an interval between an edge of the (i−1) th grayscale pulse ($2 \leqq i \leqq N$, i is an integer) and an edge of the ith grayscale pulse may be set based on a value set in the grayscale pulse setting register, within a predetermined period which starts at the change timing of the first horizontal blanking adjustment signal and ends at a next change timing of the first horizontal blanking adjustment signal; and wherein an interval between a change timing of the second horizontal blanking adjustment signal and an edge of the first grayscale pulse, and an interval between an edge of the (i−1) th grayscale pulse and an edge of the ith grayscale pulse may be set based on a value set in the grayscale pulse setting register, within a predetermined period which starts at the change timing of the second horizontal blanking adjustment signal and ends at a next change timing of the second horizontal blanking adjustment signal.

Since an interval between the grayscale pulses of the grayscale clock signal can be set in this embodiment, pulse widths obtained by PWM can be made different even if the values of the grayscale data is the same. This enables desired grayscale representation to be implemented by performing fine gamma correction of the display panel. In particular, since manufacturing technology of organic EL panels is immature differing from liquid crystal panels and the technology variation is great, it is particularly effective that fine gamma correction can be implemented.

Moreover, since the first and second grayscale clock signals are respectively supplied to the first and second data drivers, a display region of the display panel in which data lines are driven by the first data driver and a display region of the display panel in which data lines are driven by the second data driver can be caused to exhibit the same image quality.

The display controller may further comprise:

first and second horizontal blanking period setting registers in which periods which start at a start timing of one horizontal scan period and end at change timings of the first and second horizontal blanking adjustment signals are respectively set, wherein the blanking adjustment signal generation section may change the first horizontal blanking adjustment signal when a period corresponding to a value set in the first horizontal blanking period setting register has elapsed from the start timing; and wherein the blanking adjustment signal generation section may change the second horizontal blanking adjustment signal when a period corresponding to a value set in the second horizontal blanking period setting register has elapsed from the start timing.

In this embodiment, since the change timings of the first and second horizontal blanking adjustment signals can be separately controlled, a flicker which may occur depending on the type or manufacturing variation of the display panel driven by the first and second data drivers can be prevented, or luminance can be adjusted.

In this display controller, the blanking adjustment signal generation section may generate first and second vertical blanking adjustment signals respectively used for setting first and second vertical blanking periods in which the first and second latch pulse signals having the pulses which specify one horizontal scan period are respectively output;

the second vertical blanking adjustment signal may change earlier than the first vertical blanking adjustment signal by a period corresponding to the phase difference set in the offset period setting register; and the display controller may output the first and second vertical blanking adjustment signals respectively to first and second scan drivers which drive the scan lines of the display panel, the display panel including display elements which are discharged based on the first and second horizontal blanking adjustment signals and the first and second vertical blanking adjustment signals.

In this embodiment, the display controller outputs the first and second vertical blanking adjustment signals while making the output timings of the first and second vertical blanking adjustment signals different from each other by a period corresponding to the phase difference set in the offset period setting register. This enables to easily prevent the simultaneous generation of the peak currents due to the simultaneous changes of the first and second vertical blanking adjustment signals. Moreover, fine timing adjustment can be implemented without changing image quality in a display region of the display panel in which scan lines are scanned by the first scan driver to which the first vertical blanking adjustment signal is supplied and in a display region of the display panel in which scan lines are scanned by the second scan driver to which the second vertical blanking adjustment signal is supplied.

The display controller may further comprise:

first and second vertical blanking period setting registers in which periods which start at a start timing of one horizontal scan period and end at change timings of the first and second vertical blanking adjustment signals are respectively set, wherein the blanking adjustment signal generation section may change the first vertical blanking adjustment signal when a period corresponding to a value set in the first vertical blanking period setting register has elapsed from the start timing; and wherein the blanking adjustment signal generation section may change the second vertical blanking adjustment signal when a period corresponding to a value set in the second vertical blanking period setting register has elapsed from the start timing.

In this embodiment, since the change timings of the first and second vertical blanking adjustment signals can be separately controlled, a flicker which may occur depending on the type and manufacturing variation of the display panel driven by the first and second scan drivers can be prevented, or luminance can be adjusted.

The display controller may further comprise:

a vertical synchronization signal generation section which generates a vertical synchronization signal based on the number of horizontal display dots, the number of the scan lines, and an idle period set in one horizontal scan period, the vertical synchronization signal having a pulse for specifying one vertical scan period, wherein the vertical synchronization signal may be output to the first or second scan driver.

According to one embodiment of the present invention, there is provided a display system, comprising:

a display panel which includes: a plurality of scan lines; a plurality of data lines; and a plurality of electroluminescent elements, each of the electroluminescent elements including one of the scan lines and one of the data lines;

a scan driver which scans the scan lines;

first and second data drivers which drive the data lines; and the above-described display controller, wherein the display controller outputs the first and second latch pulse signals respectively to the first and second data drivers which store the display data for one horizontal scan period based on the first and second latch pulse signals.

In this embodiment, a display system which can cause a display region of the display panel in which data lines are driven by the first data driver and a display region of the display panel in which data lines are driven by the second data driver to exhibit the same image quality without being affected by decrease in power supply voltage can be provided.

According to one embodiment of the present invention, there is provided a display system, comprising:

a display panel which includes: a plurality of scan lines; a plurality of data lines; and a plurality of electroluminescent elements, each of the electroluminescent elements including one of the scan lines and one of the data lines;

first and second scan drivers which scan the scan lines;

first and second data drivers which drive the data lines; and the above-described display controller, wherein the display controller outputs the first and second horizontal blanking adjustment signals respectively to the first and second data drivers, and outputs the first and second vertical blanking adjustment signals respectively to the first and second scan drivers; and wherein the electroluminescent elements are discharged based on the first and second horizontal blanking adjustment signals and the first and second vertical blanking adjustment signals.

In this embodiment, a display system which can cause display regions of the display panel driven by the first and second data drivers and the first and second scan drivers to exhibit the same image quality without being affected by decrease in power supply voltage can be provided.

According to one embodiment of the present invention, there is provided a display control method for controlling first and second data drivers which drive a plurality of data lines of a display panel, the display panel including a plurality of scan lines in addition to the data lines, and the display control method comprising:

generating first and second latch pulse signals having pulses which specify one horizontal scan period, the second latch pulse signal changing earlier than the first latch pulse signal by a period corresponding to a phase difference between the first and second latch pulse signals, the phase difference being set in an offset period setting register; and outputting the first and second latch pulse signals respectively to the first and second data drivers which store display data for one horizontal scan period based on the first and second latch pulse signals.

The display control method may further comprise:

generating a second horizontal blanking adjustment signal which changes earlier than a first horizontal blanking adjustment signal by a period corresponding to the phase difference set in the offset period setting register, the first horizontal blanking adjustment signal being used for setting a first horizontal blanking period in which the first latch pulse signal having a pulse which specifies one horizontal scan period is output, and the second horizontal blanking adjustment signal being used for setting a second horizontal blanking period in which the second latch pulse signal having a pulse which specifies one horizontal scan period is output;

outputting the first horizontal blanking adjustment signal and a first grayscale clock signal to the first data driver which drives the data lines by using a signal pulse-width-modulated based on the first horizontal blanking adjustment signal and the first grayscale clock signal, the first grayscale clock signal having first to Nth grayscale pulses (N is an integer greater than one) in a predetermined period; and outputting the second horizontal blanking adjustment signal and a second grayscale clock signal to the second data driver which drives the data lines by using a signal pulse-width-modulated based on the second horizontal blanking adjustment signal and the second grayscale clock signal, the second grayscale clock signal having first to Nth grayscale pulses in a predetermined period.

The embodiments of the present invention will be described in detail with reference to the drawings. Note that the embodiments described below do not in any way limit the scope of the invention laid out in the claims herein. In addition, not all of the elements of the embodiments described below should be taken as essential requirements of the present invention.

1. Display System

FIG. 1 is a block diagram showing a display system.

A display system 500 includes an organic EL panel (display panel in a broad sense) 510, a data driver 520, a scan driver 530, and a display controller 540. The display system 500 does not necessarily include all of these circuit blocks. The display system 500 may have a configuration in which some of the circuit blocks are omitted. The display system 500 may be configured to include a host 550.

The organic EL panel 510 is a simple matrix type. FIG. 1 shows an electrical configuration of the organic EL panel 510. Specifically, the organic EL panel 510 includes a plurality of scan lines (cathodes in a narrow sense), a plurality of data lines (anodes in a narrow sense), and a plurality of organic EL elements (display elements in a broad sense), each of the organic EL elements being connected with one of the scan lines and one of the data lines.

In more detail, the organic EL panel is formed on a glass substrate. A plurality of data lines DL1 to DLx (x is an integer greater than one), arranged in a direction X shown in FIG. 1 and extending in a direction Y, are formed on the glass substrate. A plurality of scan lines GL1 to GLy (y is an integer greater than one), arranged in the direction Y shown in FIG. 1 and extending in the direction X, are formed on the glass substrate so that the scan lines intersect the data lines. In the case where one pixel is formed by three color components consisting of an R component, a G component, and a B component, a plurality of sets of data lines, each of the sets consisting of an R component data line, a G component data line, and a B component data line, are arranged in the organic EL panel 510.

An organic EL element is formed at a position corresponding to the intersecting point of the data line DLj ($1 \leqq j \leqq x$, j is an integer) and the scan line GLk ($1 \leqq k \leqq y$, k is an integer).

Figure 2:
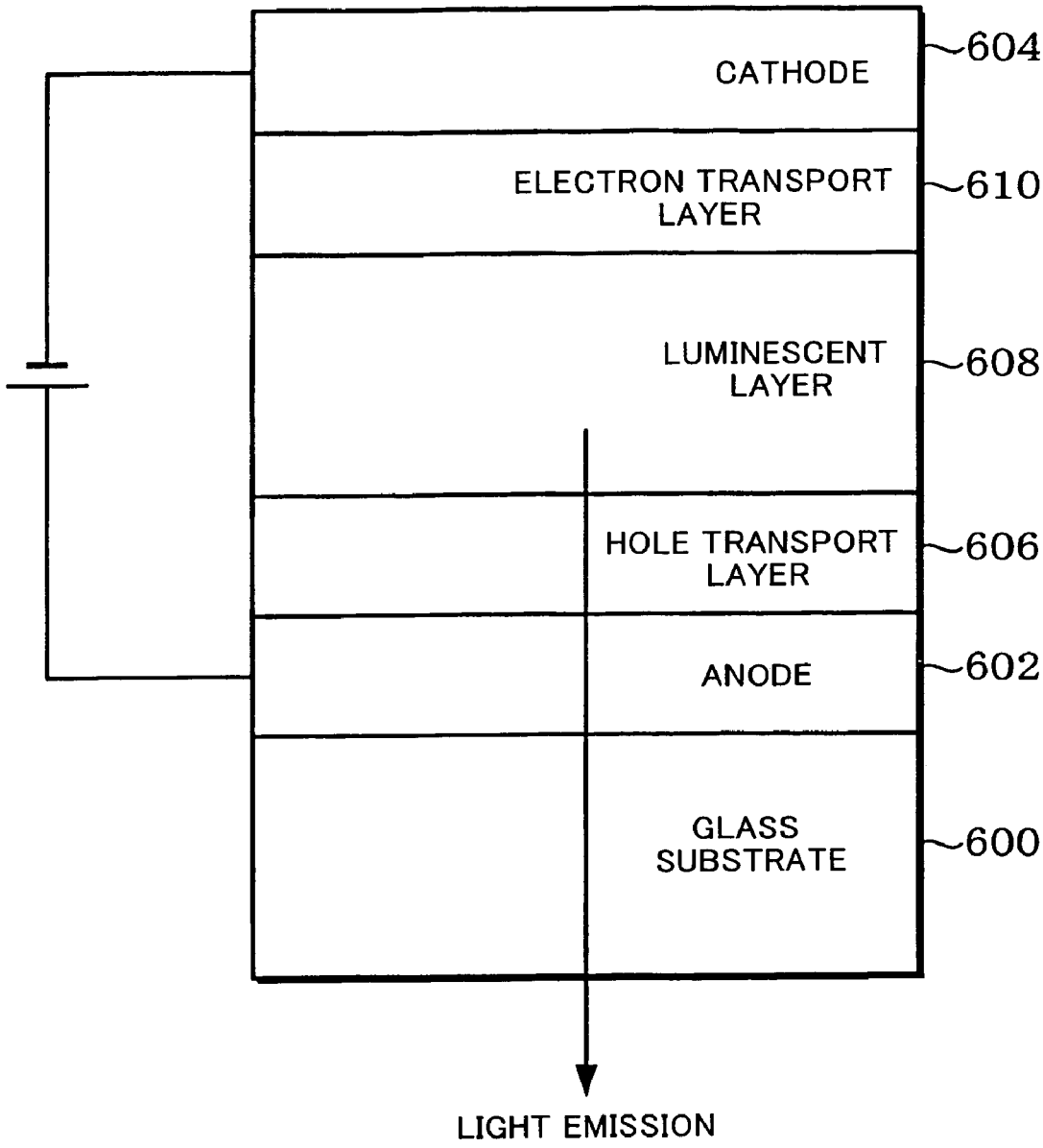
FIG. 2 is illustrative of a structure of an organic EL element.

FIG. 2 is illustrative of the structure of the organic EL element.

In the organic EL element, a transparent electrode (indium thin oxide (ITO), for example) which functions as an anode 602 provided as the data line is formed on a glass substrate 600. A cathode 604 provided as the scan line is formed above the anode 602. An organic layer including a luminescent layer and the like is formed between the anode 602 and the cathode 604.

The organic layer includes a hole transport layer 606 formed on the upper surface of the anode 602, a luminescent layer 608 formed on the upper surface of the hole transport layer 606, and an electron transport layer 610 formed between the luminescent layer 608 and the cathode 604.

A hole from the anode 602 and an electron from the cathode 604 are recombined in the luminescent layer 608 by applying a potential difference between the data line and the scan line, specifically, by applying a potential difference between the anode 602 and the cathode 604. The molecules of the luminescent layer 608 are excited by the energy generated, and the energy released when the molecules return to the ground state becomes light. The light passes through the anode 602 formed of a transparent electrode and the glass substrate 600.

In FIG. 1, the data driver 520 drives the data line based on grayscale data (display data in a broad sense). The data driver 520 generates a PWM signal having a pulse width corresponding to the grayscale data, and drives the data line based on the PWM signal.

The scan driver 530 sequentially selects the scan line. As a result, current flows through the organic EL element connected with the data line which intersects the selected scan line, whereby light is emitted.

The display controller 540 controls the data driver 520 and the scan driver 530 according to the content set by the host 550 such as a central processing unit (CPU). In more detail, the display controller 540 sets an operation mode of the data driver 520, and supplies a latch pulse signal (horizontal synchronization signal) LP, a grayscale clock signal GCLK (R component grayscale signal GCLKR, G component grayscale clock signal GCLKG, and B component grayscale clock signal GCLKB) for generating the PWM signal, a dot clock signal DCLK, a discharge signal DIS1 (horizontal blanking adjustment signal in a broad sense), and grayscale data D generated therein to the data driver 520, for example. A horizontal scan period is specified by the latch pulse signal LP. The display controller 540 sets an operation mode of the scan driver 530, and supplies a vertical synchronization signal YD, a latch pulse signal LP, and a discharge signal DIS2 (vertical blanking adjustment signal in a broad sense) generated therein to the scan driver 530, for example. A vertical scan period is specified by the vertical synchronization signal YD.

FIG. 1 shows the case of driving the organic EL panel 510 using one data driver 520 and one scan driver 530. However, the same description applies to the case of driving an organic EL panel 520 using a plurality of data drivers 520 and a plurality of scan drivers 530. In this case, the data drivers are cascade-connected, and the scan drivers are cascade-connected. The display controller 540 in this embodiment can separately supply the synchronization signal to each of the data drivers and each of the scan drivers. In more detail, the display controller 540 supplies at least the latch pulse signal LP, the grayscale clock signal GCLK, and the discharge signal DIS1 to each of the data drivers. The display controller 540 supplies at least the discharge signal DIS2 to each of the scan drivers.

Some or all of the data driver 520, the scan driver 530, and the display controller 540 may be formed on the organic EL panel 510.

1.1 Data Driver

Figure 3:
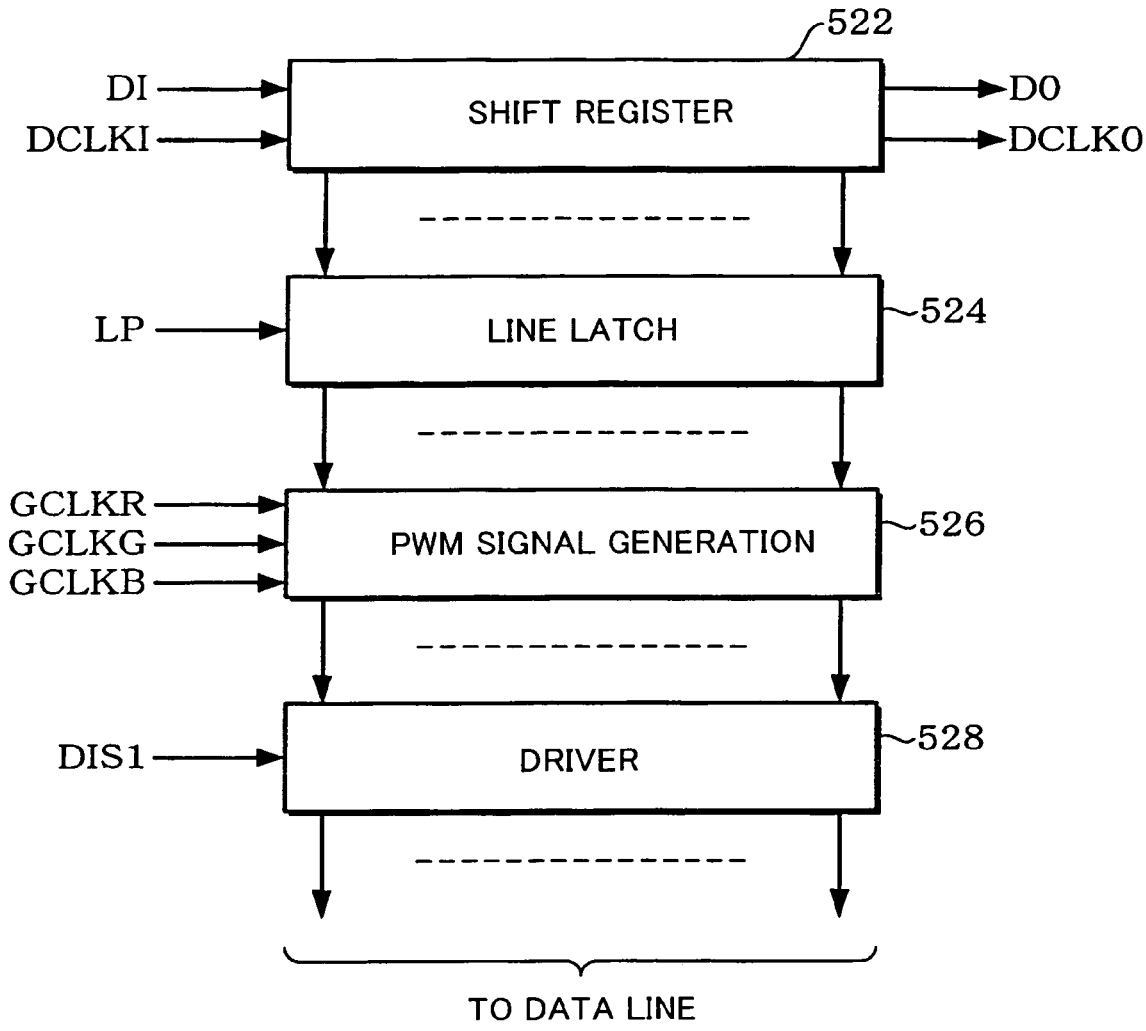
FIG. 3 is a block diagram showing the data driver of FIG. 1.

FIG. 3 shows the data driver 520 of FIG. 1.

The data driver 520 includes a shift register 522, a line latch 524, a PWM signal generation circuit 526, and a driver circuit 528. The data driver 520 has a configuration which allows cascade connection by serially connecting the shift register 522 with a shift register of another data driver.

The shift register 522 includes a plurality of flip-flops, each of the flip-flops being provided corresponding to one of the data lines and being sequentially connected. A dot clock signal DCLKI from the display controller 540 is input to each of the flip-flops. R component grayscale data, G component grayscale data, B component grayscale data, R component grayscale data, . . . are sequentially input to the flip-flop in the first stage of the shift register 522 from the display controller 540 in four bit units in synchronization with the dot clock signal DCLKI, for example. The R component grayscale data is data for driving the R component data line. The G component grayscale data is data for driving the G component data line. The B component grayscale data is data for driving the B component data line. The shift register 522 stores the grayscale data in synchronization with the dot clock signal DCLKI while shifting the grayscale data.

The shift register 522 outputs the dot clock signal DCLKI from the display controller 540 as a dot clock signal DCLKO. The shift register 522 outputs the grayscale data output from the flip-flop in the final stage as grayscale data DO. The dot clock signal DCLKO and the grayscale data DO are input to a shift register of a data driver which is cascade-connected in the subsequent stage. The shift register of the data driver in the subsequent stage stores the grayscale data in the same manner as the shift register 522.

The line latch 524 latches the grayscale data in one horizontal scan unit stored by the shift register 522 in synchronization with the latch pulse signal LP supplied from the display controller 540.

The PWM signal generation circuit 526 generates the PWM signal for driving the data line. In more detail, the PWM signal generation circuit 526 generates the PWM signal of which the change point is specified by the grayscale clock signal (grayscale pulse of the grayscale clock signal in more detail) based on the grayscale data corresponding to the data line. The PWM signal has a pulse width in the number of pulses of the grayscale clock signal GCLK corresponding to the grayscale data. The PWM signal generation circuit 526 generates a PWM signal PWMR for the R component data line using the R component grayscale clock signal GCLKR and the R component grayscale data stored corresponding to the data line. The PWM signal generation circuit 526 generates a PWM signal PWMG for the G component data line using the G component grayscale clock signal GCLKG and the G component grayscale data stored corresponding to the data line. The PWM signal generation circuit 526 generates a PWM signal PWMB for the B component data line using the B component grayscale clock signal GCLKB and the B component grayscale data stored corresponding to the data line.

The driver circuit 528 drives the data line based on the PWM signal generated by the PWM signal generation circuit 526. The discharge signal DIS1 from the display controller 540 is input to the driver circuit 528. The horizontal display period within the horizontal scan period specified by the latch pulse signal LP is specified by the discharge signal DIS1. The horizontal display period is a period which starts at the falling edge of the discharge signal DIS1 and ends at the next rising edge of the discharge signal DIS1. A pulse of the latch pulse signal LP is output within a period in which the discharge signal DIS1 is set at the H level.

The driver circuit 528 connects the data line with a ground potential when the discharge signal DIS1 is set at the H level, and supplies a predetermined current to the data line for a period corresponding to the pulse width of the PWM signal when the discharge signal DIS1 is set at the L level.

The data driver 520 prevents the data line from being driven by the grayscale data in the middle of rewriting by latching the grayscale data in the next horizontal scan period in the line latch 524 when the discharge signal DIS1 is set at the H level.

1.2 Scan Driver

Figure 4:
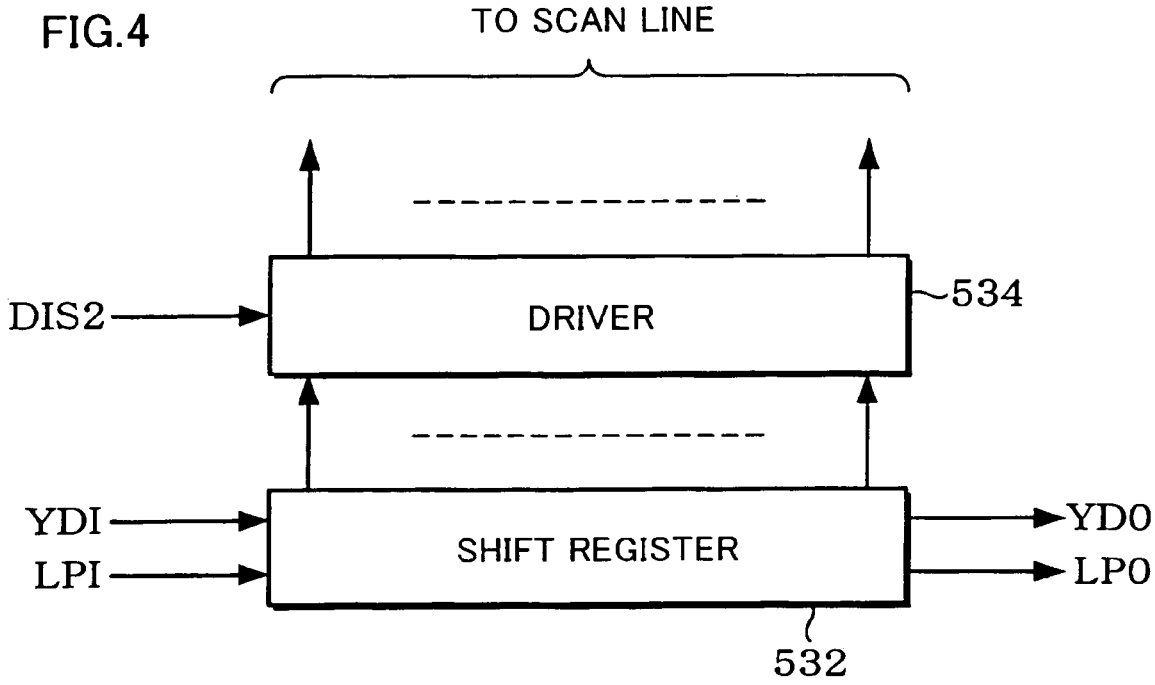
FIG. 4 is a block diagram showing the scan driver of FIG. 1.

FIG. 4 shows the scan driver 530 of FIG. 1.

The scan driver 530 includes a shift register 532 and a driver circuit 534. The scan driver 530 has a configuration which allows cascade connection by serially connecting the shift register 532 with a shift register of another scan driver.

The shift register 532 includes a plurality of flip-flops, each of the flip-flops being provided corresponding to one of the scan lines and being sequentially connected. A latch pulse signal LPI from the display controller 540 is input to each of the flip-flops. A vertical synchronization signal YDI from the display controller 540 is input to the flip-flop in the first stage of the shift register 532. The shift register 532 shifts a pulse of the vertical synchronization signal YDI in synchronization with the latch pulse signal LPI.

The shift register 532 outputs the latch pulse signal LPI from the display controller 540 as a latch pulse signal LPO. The shift register 532 outputs the vertical synchronization signal output from the flip-flop in the final stage as a vertical synchronization signal YDO. The latch pulse signal LPO and the vertical synchronization signal YDO are input to a shift register of a scan driver which is cascade-connected in the subsequent stage. The shift register of the scan driver in the subsequent stage shifts the pulse of the vertical synchronization signal YDO in the same manner as the shift register 532.

The driver circuit 534 sequentially outputs a select pulse to the scan line based on the output from the flip-flop of the shift register 532. The discharge signal DIS2 from the display controller 540 is input to the driver circuit 534. The driver circuit 534 connects all the scan lines with the ground potential when the discharge signal DIS2 is set at the H level, and connects only the selected scan line with the ground potential and connects the remaining scan lines with a predetermined potential when the discharge signal DIS2 is set at the L level.

1.3 Discharge Operation

Figure 5:
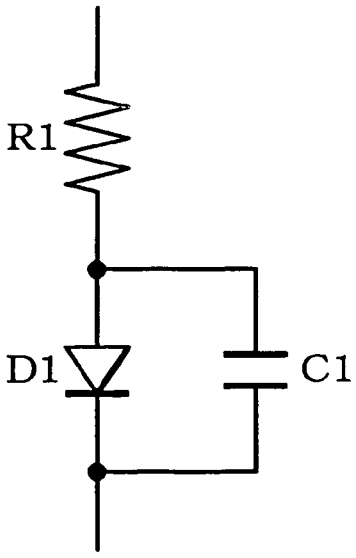
FIG. 5 is an electrical equivalent circuit diagram showing an organic EL element.

FIG. 5 shows an electrical equivalent circuit diagram of the organic EL element.

The organic EL element is considered to be equivalent to a configuration in which a resistance component R1 and a diode D1 are connected in series and which includes a parasitic capacitor C1 connected in parallel with the diode D1. The parasitic capacitor C1 is considered to be a capacitance component corresponding to a depletion layer formed at the junction when a potential difference is applied between the anode 602 and the cathode 604. Therefore, the organic EL element is considered to be a capacitive load.

Therefore, in the display system 500, the effect of the preceding horizontal scan period can be eliminated by performing a discharge operation of the organic EL elements of the organic EL panel 510 using the discharge signals DIS1 and DIS2.

Figure 6:
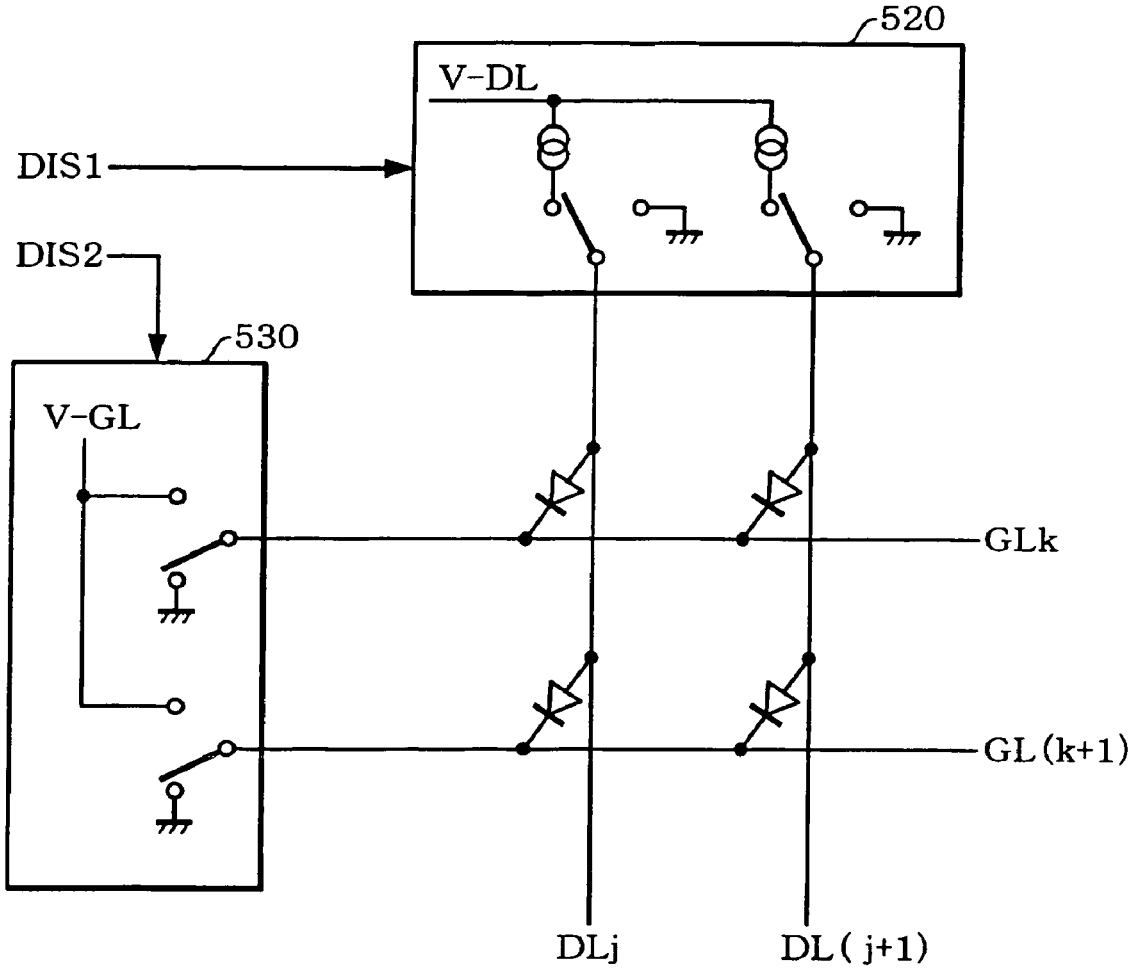
FIG. 6 is illustrative of a discharge operation.

FIG. 6 is illustrative of the discharge operation. In FIG. 6, sections the same as the sections of the display system shown in FIG. 1 are indicated by the same symbols.

The data driver 520 supplies a predetermined current to the data line for a period of the pulse width corresponding to the PWM signal when the discharge signal DIS1 is set at the L level. The data driver 520 connects all the data lines with the ground potential when the discharge signal DIS1 is set at the H level.

When the discharge signal DIS2 is set at the L level, the scan driver 530 connects only the selected scan line with the ground potential and connects the remaining scan lines with a potential V-GL. The scan driver 530 connects all the scan lines with the ground potential when the discharge signal DIS2 is set at the H level.

Therefore, current flows through the organic EL elements connected with the selected scan line when the discharge signals DIS1 and DIS2 are set at the L level. The potentials on opposite ends of the organic EL elements become equal when the discharge signals DIS1 and DIS2 are set at the H level, whereby the organic EL elements can be discharged.

A flicker which may occur depending on the type and manufacturing variation of the organic EL panel can be prevented or luminance can be adjusted by adjusting the length of the horizontal display period within the horizontal scan period. The blanking period can be adjusted by using the discharge signals DIS1 and DIS2. Therefore, the discharge signal DIS1 may be called a horizontal blanking adjustment signal, and the discharge signal DIS2 may be called a vertical blanking adjustment signal.

2. Display Controller 2.1. Cascade Connection

The display controller 540 in this embodiment can output a plurality of latch pulse signals. The display controller 540 can provide a phase difference between the change timings of the latch pulse signals, and can adjust the phase difference. The latch pulse signals are supplied to each of a plurality of cascade-connected data drivers. Each of the data drivers latches the grayscale data in synchronization with the latch pulse signal from the display controller 540, and supplies drive signals corresponding to the latched grayscale data to the data lines. Therefore, even if each of the data drivers latches the grayscale data (performs the switch operation) in synchronization with the latch pulse signal supplied thereto, since the peak current generation timings are made different from each other, the decrease in power supply voltage of the data drivers is equalized, whereby the level of a decrease in voltage can be reduced.

This prevents the display quality of the organic EL panel from being affected by a decrease in power supply voltage of the data drivers even if the organic EL element has a high response speed. Moreover, since the display controller 540 can adjust the output timings of the latch pulse signals, the peak current generation timings of the data drivers can be precisely made different from each other with high accuracy. Therefore, the timing which differs depending on the type of organic EL panel, compatibility between the data driver and the organic EL panel, manufacturing variation, and the like can be precisely adjusted with high accuracy, whereby the number of parts accompanying adjustment, design cost, and the number of development steps can be reduced.

The following description illustrates the case where cascade-connected drivers are connected in two stages. However, the same description also applies to the case where cascade-connected drivers are connected in three or more stages. The present invention is not limited to the number of stages.

Figure 7:
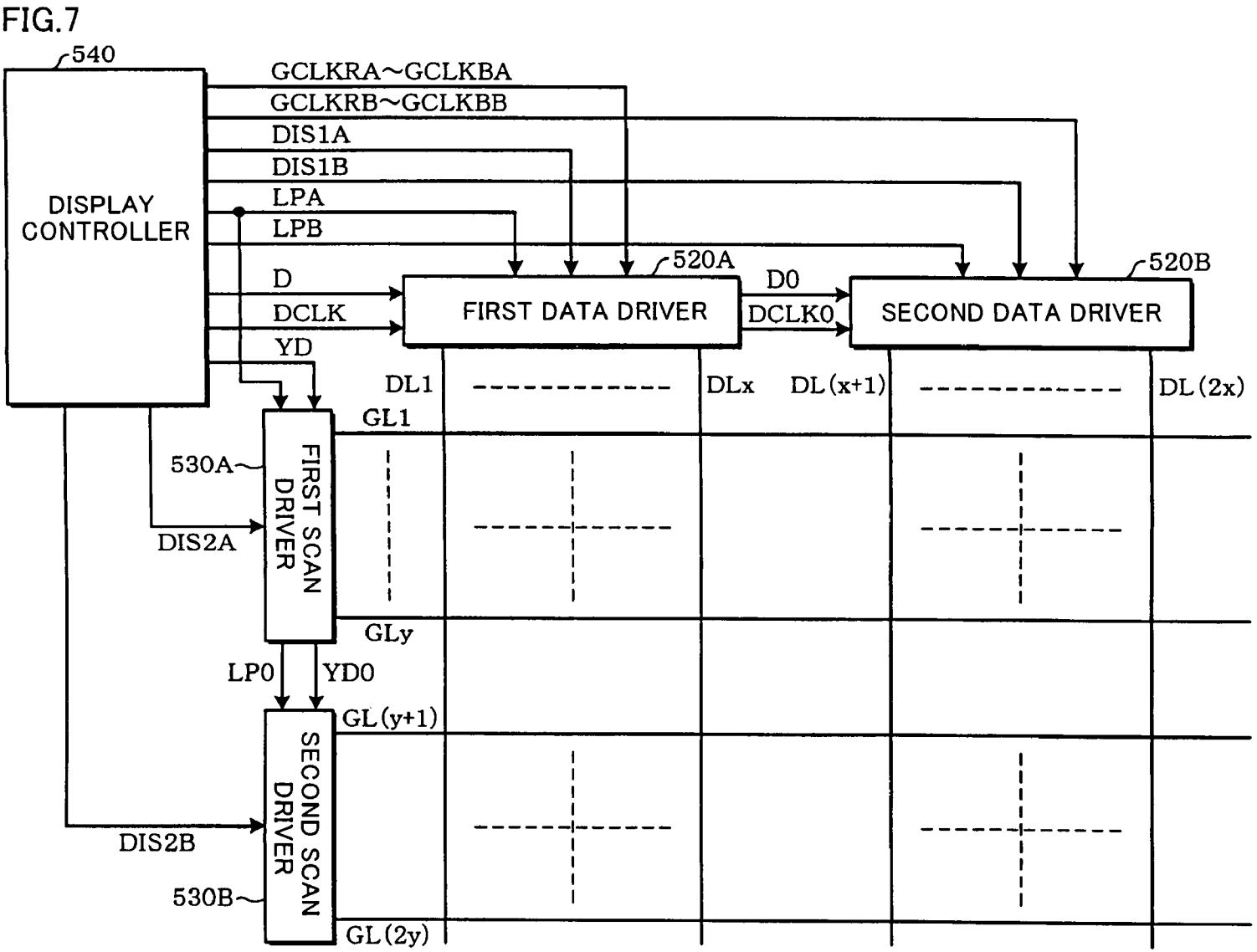
FIG. 7 is a diagram showing an example of the connection between a display controller and two cascade-connected drivers.

FIG. 7 schematically shows an example of connection between the display controller and two cascade-connected drivers. Note that components corresponding to those in FIG. 1 are denoted by the same reference numbers, and further description thereof is appropriately omitted. FIG. 7 shows the case where the display controller 540 is connected with two cascade-connected data drivers and two cascade-connected scan drivers.

First and second data drivers 520A and 520B shown in FIG. 7 have a configuration the same as the configuration of the data driver 520 shown in FIG. 3. First and second scan drivers 530A and 530B shown in FIG. 7 have a configuration the same as the configuration of the scan driver 530 shown in FIG. 4.

The display controller 540 supplies the grayscale data D and the dot clock signal DCLK to a shift register (not shown) of the first data driver 520A. The first data driver 520A shifts the grayscale data D in synchronization with the dot clock signal DCLK. The grayscale data DO which is shifted and output from the first data driver 520A is supplied to a shift register (not shown) of the second data driver 520B. The dot clock signal DCLKO output from the first data driver 520A is supplied to the shift register (not shown) of the second data driver 520B.

The display controller 540 outputs a first latch pulse signal LPA to the first data driver 520A, and outputs a second latch pulse signal LPB to the second data driver 520B. The display controller 540 includes an offset period setting register (not shown in FIG. 7) in which the phase difference between the first and second latch pulse signals LPA and LPB is set, and can make the change timings of the first and second latch pulse signals LPA and LPB different from each other for the phase difference corresponding to the value set in the offset period setting register. As a result, since the peak current generation timings, which occur at the same time when the latch timings occur at the same time, can be made different from each other, fine timing adjustment can be implemented by preventing a decrease in power supply voltage of the data drivers without changing the image quality in the display region driven by the data lines DL1 to DLx and the display region driven by the data lines DL(x+1) to DL(2x).

The display controller 540 can output a plurality of (horizontal) discharge signals DIS1 of which the change timings are made different from each other. In FIG. 7, the display controller 540 outputs a discharge signal DISLA (first horizontal blanking adjustment signal) to the first data driver 520A, and outputs a discharge signal DIS1B (second horizontal blanking adjustment signal) to the second data driver 520B. The display controller 540 can make the change timings of the discharge signals DISLA and DIS1B different from each other for the phase difference corresponding to the value set in the offset period setting register. As a result, the peak current generation timings, which occur at the same time when the change timings of the discharge signals DIS1A and DIS1B occur at the same time, can be easily made different from each other. Moreover, fine timing adjustment can be implemented without changing the image quality in the display region driven by the data lines DL1 to DLx and the display region driven by the data lines DL(x+1) to DL(2x).

The display controller 540 can output a plurality of grayscale clock signals, the change timings of the grayscale clock signals having each RGB color component being made different from each other. In FIG. 7, the display controller 540 outputs first grayscale clock signals GCLKRA to GCLKBA to the first data driver 520A, and outputs second grayscale clock signals GCLKRB to GCLKBB to the second data driver 520B. The display controller 540 can make the change timings of the first and second grayscale clock signals of each color component (GCLKRA and GCLKRB, GCLKGA and GCLKGB, GCLKBA and GCLKBB, for example) different from each other for the phase difference corresponding to the value set in the offset period setting register. As a result, the peak current generation timings, which occur at the same time when the change timings of the grayscale clock signals occur at the same time, can be easily made different from each other. Moreover, fine timing adjustment can be implemented without changing the image quality in the display region driven by the data lines DL1 to DLx and the display region driven by the data lines DL(x+1) to DL(2x).

The display controller 540 supplies the vertical synchronization signal YD and the first latch pulse signal LPA to a shift register (not shown) of the first scan driver 530A. The first scan driver 530A shifts a pulse of the vertical synchronization signal YD in synchronization with the first latch pulse signal LPA. The pulse YDO of the vertical synchronization signal YD which is shifted and output from the first scan driver 530A is supplied to a shift register (not shown) of the second scan driver 530B. The latch pulse signal LPO (first latch pulse signal LPA) output from the first scan driver 530A is supplied to the shift register (not shown) of the second scan driver 530B.

The display controller 540 can output a plurality of (vertical) discharge signals DIS2 of which the change timings are made different from each other. In FIG. 7, the display controller 540 outputs a discharge signal DIS2A (first vertical blanking adjustment signal) to the first scan driver 530A, and outputs a discharge signal DIS2B (second vertical blanking adjustment signal) to the second scan driver 530B. The display controller 540 can make the change timings of the discharge signals DIS2A and DIS2B different from each other for the phase difference corresponding to the value set in the offset period setting register. As a result, the peak current generation timings, which occur at the same time when the change timings of the discharge signals DIS2A and DIS2B occur at the same time, can be easily made different from each other. Moreover, fine timing adjustment can be implemented without changing the image quality in the display region scanned by the scan lines GL1 to GLy and the display region scanned by the scan lines GL(y+1) to GL(2y).

The electroluminescent elements of the organic EL panel 510 are discharged based on the first and second horizontal blanking adjustment signals and the first and second vertical blanking adjustment signals.

In FIG. 7, the scan drivers are cascade-connected. However, the scan lines may be scanned using one scan driver.

2.2 Outline of Configuration

Figure 8:
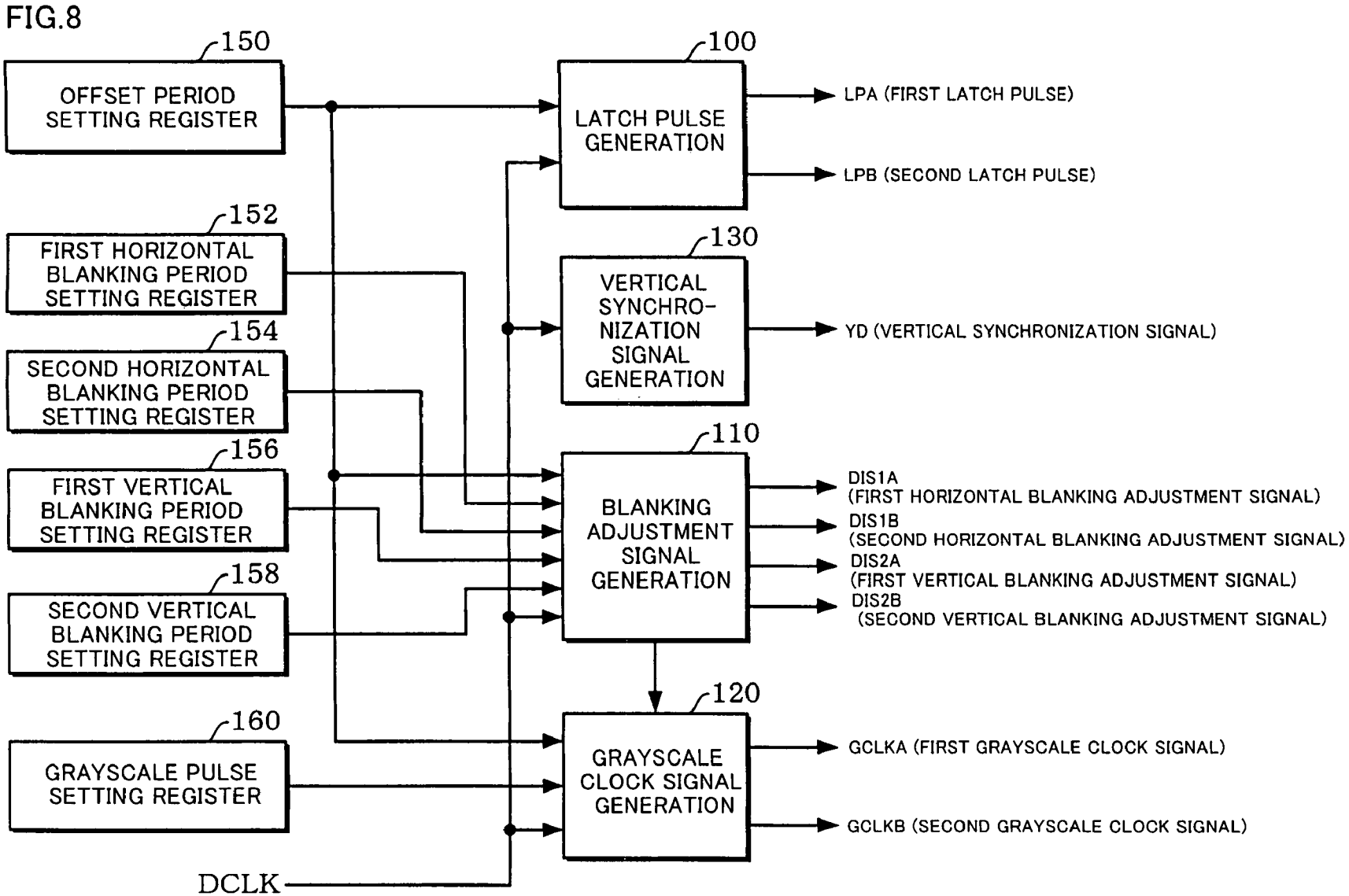
FIG. 8 is a block diagram schematically showing a display controller according to one embodiment of the present invention.

FIG. 8 shows the configuration of the display controller 540 in this embodiment.

The configuration shown in FIG. 8 may be partially omitted.

The display controller 540 may include a latch pulse signal generation section 100 and an offset period setting register 150. The latch pulse signal generation section 100 generates the first and second latch pulse signals LPA and LPB having pulses which specify one horizontal scan period. The phase difference (offset period) between the first and second latch pulse signals LPA and LPB is set in the offset period setting register 150. The latch pulse signal generation section 100 may generate the second latch pulse signal LPB which changes before the first latch pulse signal LPA for a period of the phase difference corresponding to the value set in the offset period setting register 150. The display controller 540 outputs the first and second latch pulse signals LPA and LPB respectively to the first and second data drivers 520A and 520B which store the grayscale data (display data in a broad sense) for one horizontal scan period based on the first and second latch pulse signals LPA and LPB.

The display controller 540 may further include a blanking adjustment signal generation section 110 and a grayscale clock signal generation section 120. The blanking adjustment signal generation section 110 generates the first and second horizontal blanking adjustment signals (discharge signals DISLA and DIS1B) for respectively setting the first and second horizontal blanking periods within which the pulses of the first and second latch pulse signals LPA and LPB are respectively output. The grayscale clock signal generation section 120 generates the first and second grayscale clock signals GCLKA and GCLKB, each of the grayscale clock signals having first to Nth (N is an integer greater than one) grayscale pulses within a predetermined period. In the case where each of the grayscale clock signals includes grayscale clock signals for each of the RGB color components, the grayscale clock signal generation section 120 may generate first and second grayscale clock signals GCLKRA to GCLKBA and GCLKRB to GCLKBB, each of the grayscale clock signals having first to Nth grayscale pulses within a predetermined period.

The blanking adjustment signal generation section 110 generates the second horizontal blanking adjustment signal (discharge signal DIS1B) which changes before the first horizontal blanking adjustment signal (discharge signal DIS1A) for a period of the phase difference corresponding to the value set in the offset period setting register 150. The display controller 540 outputs the first horizontal blanking adjustment signal (discharge signal DIS1A) and the first grayscale clock signal GCLKA (GCLKRA to GCLKBA) to the first data driver 520A. The first data driver 520A drives the data lines DL1 to DLx using signals pulse-width-modulated based on the first horizontal blanking adjustment signal and the first grayscale clock signal. The display controller 540 outputs the second horizontal blanking adjustment signal (discharge signal DIS1B) and the second grayscale clock signal GCLKB (GCLKRB to GCLKBB) to the second data driver 520B. The second data driver 520B drives the data lines DL(x+1) to DL(2x) using signals pulse-width-modulated based on the second horizontal blanking adjustment signal and the second grayscale clock signal.

The blanking adjustment signal generation section 110 may generate the first and second vertical blanking adjustment signals (discharge signals DIS2A and DIS2B) for respectively setting the first and second vertical blanking periods within which the pulses of the latch pulse signals (LPA and LPB) are output. The blanking adjustment signal generation section 110 may generate the second vertical blanking adjustment signal (discharge signal DIS2B) which changes before the first vertical blanking adjustment signal (discharge signal DIS2A) for a period of the phase difference corresponding to the value set in the offset period setting register 150. In this case, the display controller 540 outputs the first and second vertical blanking adjustment signals respectively to the first and second scan drivers 530A and 530B. The first and second scan drivers 530A and 530B drive the scan lines of the organic EL panel 510 (display panel) including the display elements which are discharged based on the first and second horizontal blanking adjustment signals (discharge signals DISLA and DIS1B) and the first and second vertical blanking adjustment signals (discharge signals DIS2A and DIS2B).

Figure 9:
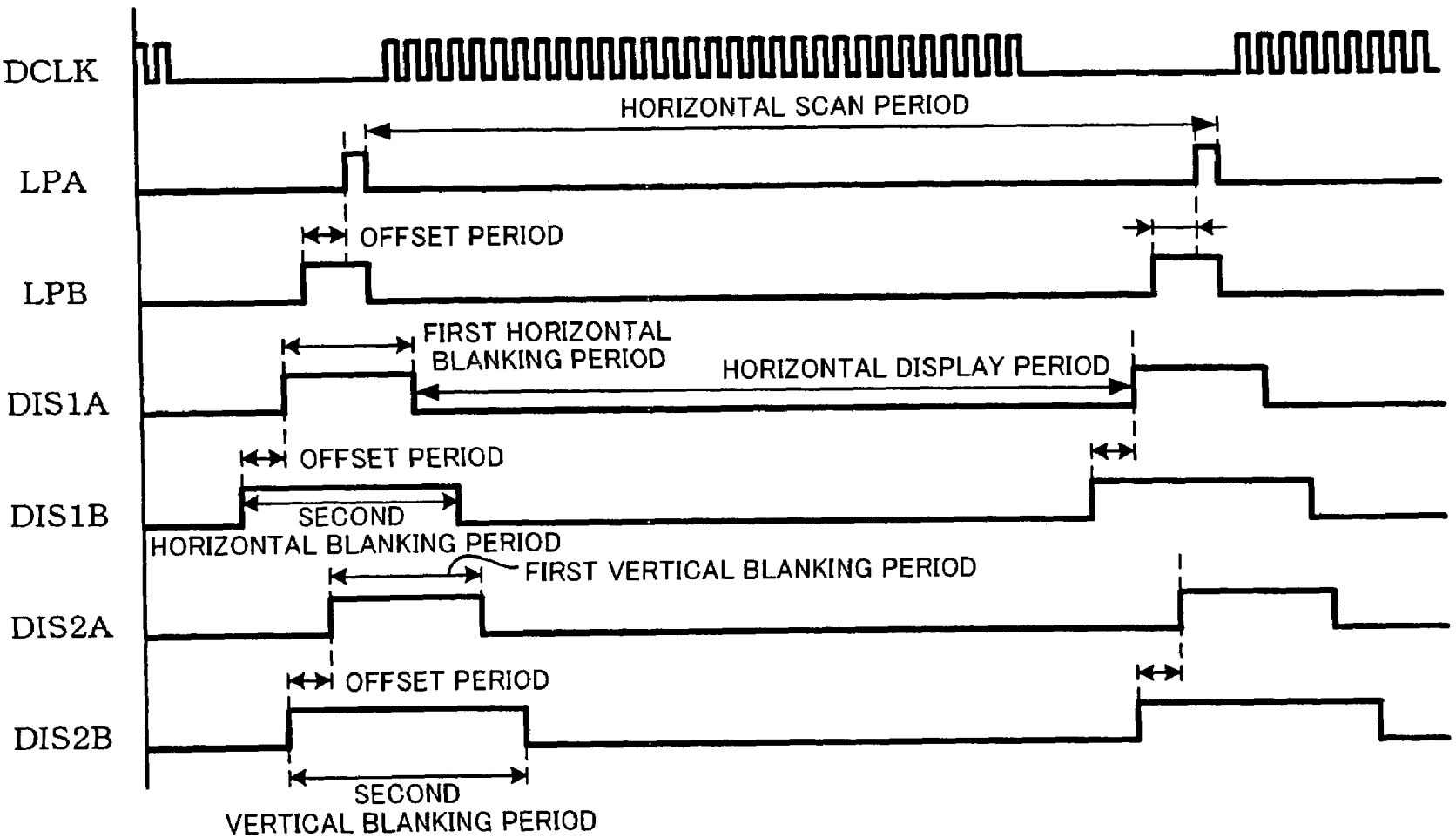
FIG. 9 is illustrative of a phase difference set in an offset period setting register.

FIG. 9 is illustrative of a phase difference (offset period) set in the offset period setting register 150.

In this embodiment, the offset period in the number of cycles of the dot clock signal DCLK corresponding to the value set in the offset period setting register 150 is set. The latch pulse signal generation section 100 generates the second latch pulse signal LPB which changes before the first latch pulse signal LPA for the offset period. Therefore, since a point near the end point of one horizontal scan period is used, the phase difference can be provided while eliminating the effect on display using PWM control, for example.

The blanking adjustment signal generation section 110 generates the second horizontal blanking adjustment signal (discharge signal DIS1B) which changes before the first horizontal blanking adjustment signal (discharge signal DIS1A) for the offset period. The blanking adjustment signal generation section 110 generates the second vertical blanking adjustment signal (discharge signal DIS2B) which changes before the first vertical blanking adjustment signal (discharge signal DIS2A) for the offset period.

As described above, fine timing adjustment can be easily implemented without changing the timing relationship between the latch pulse signals and the discharge signals by using the value set in the offset period setting register 150 in common when outputting the first and second latch pulse signals, the first and second horizontal blanking adjustment signals, and the first and second vertical blanking adjustment signals.

As shown in FIG. 8, the display controller 540 may include a vertical synchronization signal generation section 130. The vertical synchronization signal generation section 130 generates the vertical synchronization signal YD having pulses which specify one vertical scan period based on the number of horizontal display dots and the number of scan lines. The display controller 540 outputs the vertical synchronization signal YD to the first or second scan driver 530A or 530B. In FIG. 7, the vertical synchronization signal YD is output to the first scan driver 530A.

Figure 10:
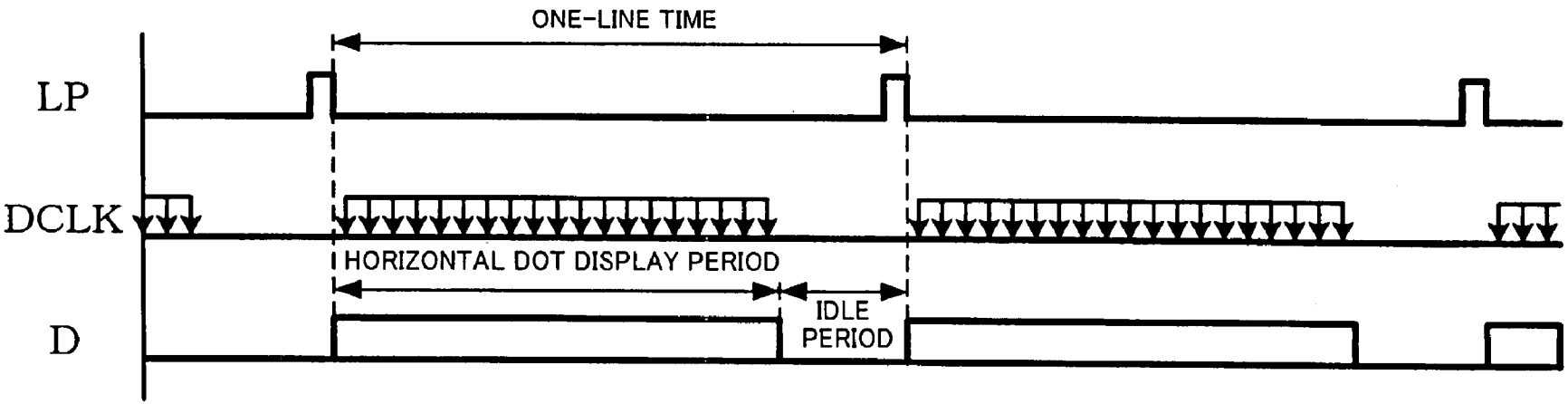
FIG. 10 is illustrative of the number of horizontal display dots.

FIG. 10 is illustrative of the number of horizontal display dots.

One horizontal scan period which is a one-line time may be defined as a period from a falling edge of a pulse in the latch pulse signal to another falling edge of the next pulse in the latch pulse signal. The display controller 540 outputs the grayscale data D corresponding to the number of horizontal display dots to the data driver in horizontal scan period units. The one-line time may be defined as the sum of a horizontal dot display period and an idle period. For example, the one-line time is uniquely determined by deciding the frequency of the dot clock signal DCLK and setting the idle period and the number of horizontal display dots.

The vertical scan period includes such a one-line time in the number of scan lines. Therefore, the vertical synchronization signal YD having pulses which specify one vertical scan period can be generated based on the number of horizontal display dots, the number of scan lines, and the idle period set within one horizontal scan period.

The display controller 540 may include first and second horizontal blanking period setting registers 152 and 154, as shown in FIG. 8. Data corresponding to the period from the start timing of one horizontal scan period until the first horizontal blanking adjustment signal (discharge signal DIS1A) changes is set in the first horizontal blanking period setting register 152. Data corresponding to the period from the start timing of one horizontal scan period until the second horizontal blanking adjustment signal (discharge signal DIS1B) changes is set in the second horizontal blanking period setting register 154. The blanking adjustment signal generation section 110 changes the first horizontal blanking adjustment signal when the period corresponding to the value set in the first horizontal blanking period setting register 152 has elapsed from the start timing of one horizontal scan period. The start timing of one horizontal scan period may be the change timing (falling edge in more detail) of the first latch pulse signal LPA. The blanking adjustment signal generation section 110 changes the second horizontal blanking adjustment signal when the period corresponding to the value set in the second horizontal blanking period setting register 154 has elapsed from the start timing of one horizontal scan period. The start timing of one horizontal scan period may be the change timing (falling edge in more detail) of the second latch pulse signal LPB. The falling edges of the first and second latch pulse signals LPA and LPB may occur at the same time. In this case, the first and second data drivers 520A and 520B may store the grayscale data at the rising edges of the first and second latch pulse signals LPA and LPB, respectively.

The display controller 540 may include first and second vertical blanking period setting registers 156 and 158, as shown in FIG. 8. The period from the start timing of one horizontal scan period until the first vertical blanking adjustment signal changes is set in the first vertical blanking period setting register 156. The period from the start timing of one horizontal scan period until the second vertical blanking adjustment signal changes is set in the second vertical blanking period setting register 158. The blanking adjustment signal generation section 110 changes the first vertical blanking adjustment signal when the period corresponding to the value set in the first vertical blanking period setting register 156 has elapsed from the start timing of one horizontal scan period. The start timing of one horizontal scan period may be the change timing (falling edge in more detail) of the first latch pulse signal LPA. The blanking adjustment signal generation section 110 changes the second vertical blanking adjustment signal when the period corresponding to the value set in the second vertical blanking period setting register 158 has elapsed from the start timing of one horizontal scan period. The start timing of one horizontal scan period may be the change timing (falling edge in more detail) of the second latch pulse signal LPB.

Figure 11:
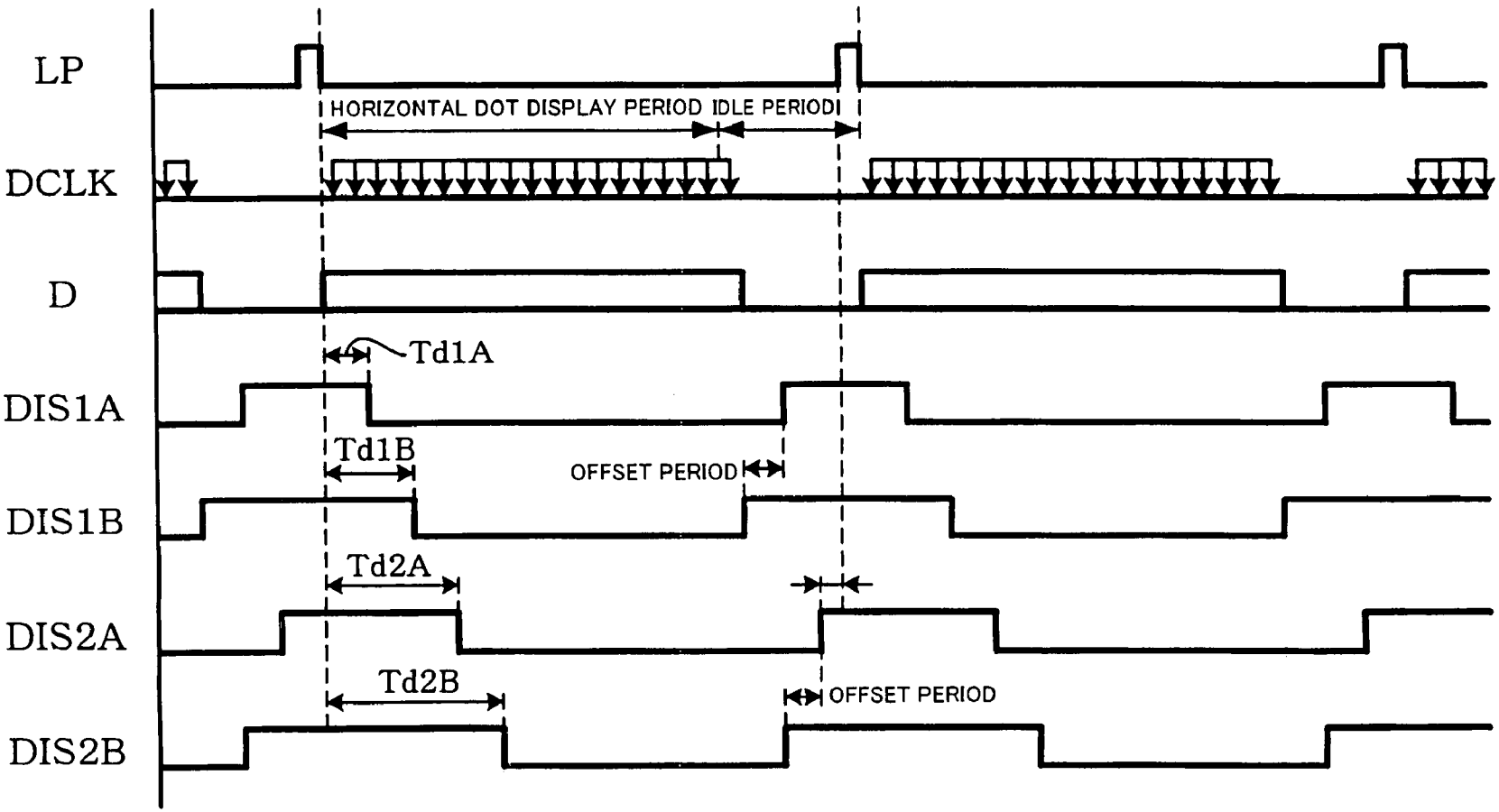
FIG. 11 is illustrative of first and second horizontal blanking period setting registers and first and second vertical blanking period setting registers.

FIG. 11 is illustrative of the first and second horizontal blanking period setting registers and the first and second vertical blanking period setting registers. FIG. 11 shows the latch pulse signal LP as the first and second latch pulse signals LPA and LPB having a common falling edge.

In this embodiment, the blanking adjustment signal is set at the H level for a period in the number of cycles of the dot clock signal DCLK corresponding to the value set in each of the first and second horizontal blanking period setting registers 152 and 154 and the first and second vertical blanking period setting registers 156 and 158. In FIG. 11, a value of the number of cycles corresponding to a period Td1A is set in the first horizontal blanking period setting register 152. A value of the number of cycles corresponding to a period Td1B is set in the second horizontal blanking period setting register 154. A value of the number of cycles corresponding to a period Td2A is set in the first vertical blanking period setting register 156. A value of the number of cycles corresponding to a period Td2B is set in the second vertical blanking period setting register 158.

A flicker which may occur depending on the type and manufacturing variation of the organic EL panel can be prevented or luminance can be adjusted by enabling the horizontal blanking period and the vertical blanking period to be set as described above.

As shown in FIG. 8, the display controller 540 may include a grayscale pulse setting register 160 for setting the edge of each grayscale pulse of the first grayscale clock signal GCLKA (GCLKRA to GCLKBA). The grayscale clock signal generation section 120 generates the first grayscale clock signal GCLKA (GCLKRA to GCLKBA) having first to Nth grayscale pulses, of which the interval between the change timing of the first horizontal blanking adjustment signal (discharge signal DIS1A) and the edge of the first grayscale pulse and the interval between the edge of the (i−1)th ($2 \leqq i \leqq N$, i is an integer) grayscale pulse and the edge of the ith grayscale pulse are set based on the value set in the grayscale pulse setting register 160, within a predetermined period (horizontal display period). The predetermined period is a period which starts at the change timing of the first horizontal blanking adjustment signal (discharge signal DIS1A) and ends at the next change timing of the first horizontal blanking adjustment signal (discharge signal DIS1A).

The grayscale clock signal generation section 120 generates the second grayscale clock signal GCLKB (GCLKRB to GCLKBB) having first to Nth grayscale pulses, of which the interval between the change timing of the second horizontal blanking adjustment signal (discharge signal DIS1B) and the edge of the first grayscale pulse and the interval between the edge of the (i−1)th ($2 \leqq i \leqq N$, i is an integer) grayscale pulse and the edge of the ith grayscale pulse are set based on the value set in the grayscale pulse setting register 160, within a predetermined period (horizontal display period). The predetermined period is a period which starts at the change timing of the second horizontal blanking adjustment signal (discharge signal DIS1B) and ends at the next change timing of the second horizontal blanking adjustment signal (discharge signal DIS1B).

Therefore, the timing of the edge of each grayscale pulse of the grayscale clock signal for specifying the change point of the PWM signal can be separately set. Therefore, PWM control performed within the horizontal display period defined by the change timings of the discharge signal can be finely performed.

2.3 Operation Principle

Figure 12:
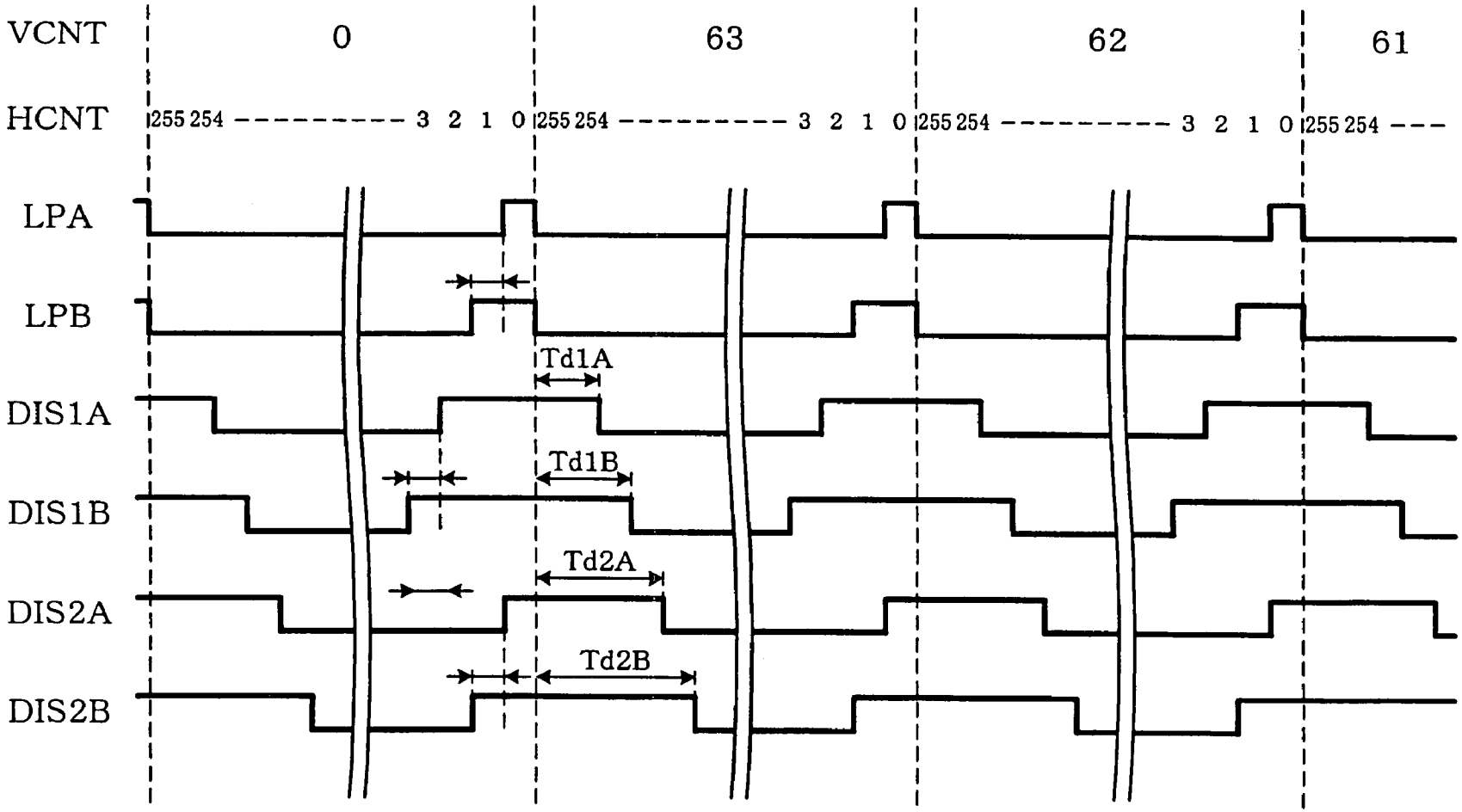
FIG. 12 is illustrative of the operation principle of a display controller according to one embodiment of the present invention.

FIG. 12 is illustrative of the operation principle of the display controller 540 in this embodiment. The display controller 540 generates various synchronization signals based on two count values VCNT and HCNT. The count value VCNT is decremented from "63" to "0" in units of one vertical scan period, for example. The count value HCNT is decremented from "255" to "0" in units of one horizontal scan period, for example. The change timings of the first and second latch pulse signals LPA and LPB and the discharge signals DIS1A, DIS1B, DIS2A, and DIS2B are specified by referring to the count values VCNT and HCNT.

For example, the first latch pulse signal LPA is set at the H level when the count value VCNT is "0" and the count value HCNT is "0". If the value set in the offset period setting register 150 is "1", the second latch pulse signal LPB is changed to the H level when the count value HCNT is "1". This enables the rising edge of the second latch pulse signal LPB to precede the rising edge of the first latch pulse signal LPA for a period corresponding to the value set in the offset period setting register 150.

The discharge signal DIS1A is set at the L level when the count value HCNT has been decremented from "255" and the period corresponding to the value set in the first horizontal blanking period setting register 152 has elapsed. The same description also applies to the discharge signals DIS1B, DIS2A, and DIS2B.

2.4 Detailed Configuration Example

A detailed configuration example of the above-described display controller 540 is described below.

Figure 13:
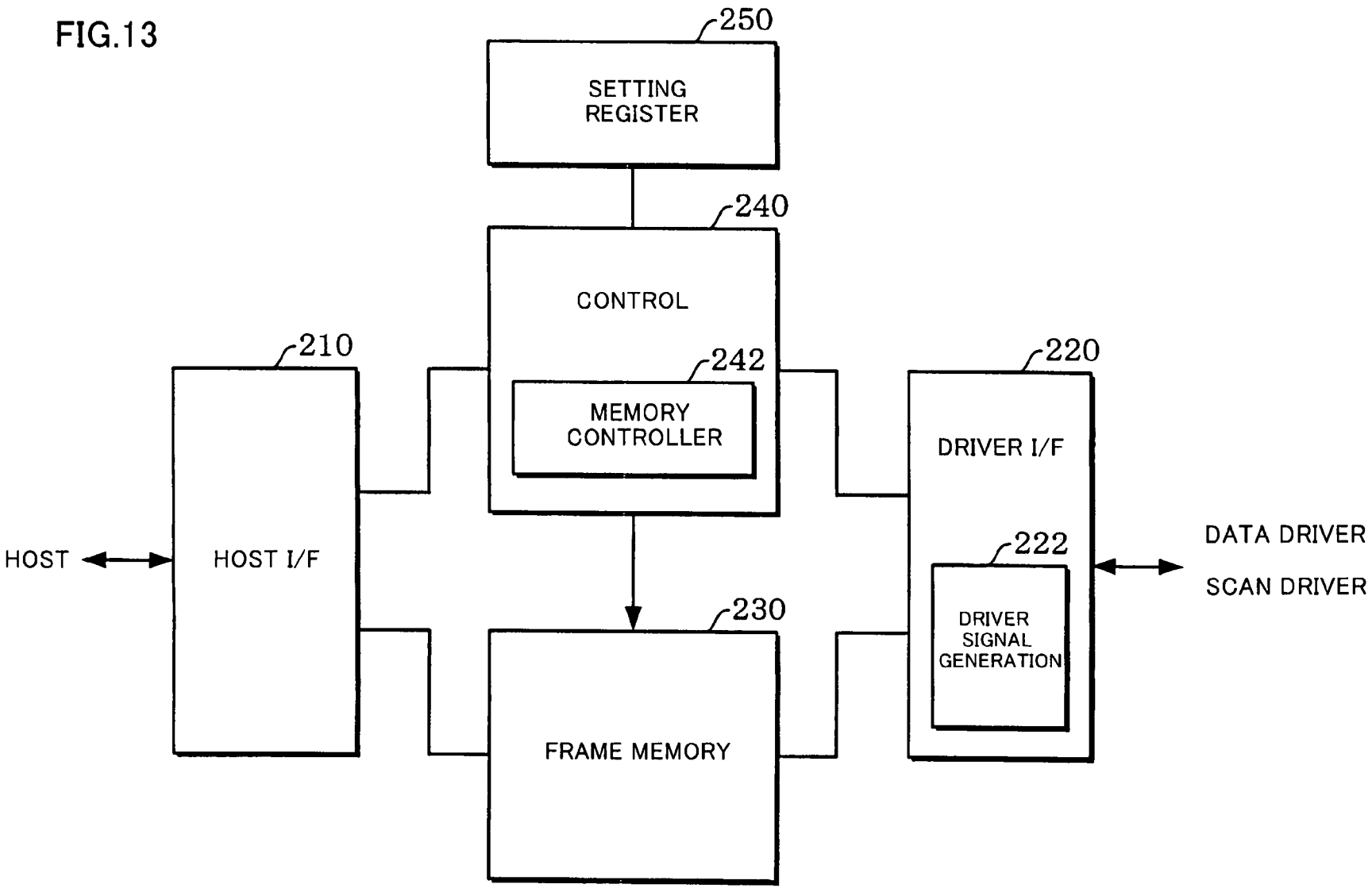
FIG. 13 is a block diagram showing a display controller according to one embodiment of the present invention.

FIG. 13 is a block diagram showing the display controller 540 in this embodiment.

The display controller 540 includes a host interface (hereinafter abbreviated as "I/F") 210, a driver I/F 220, a frame memory 230, a control section 240, and a setting register section 250.

The host I/F 210 performs interface processing with the host 550. In more detail, the host I/F 210 controls transmission and reception of data and various control signals between the display controller 540 and the host 550.

The driver I/F 220 performs interface processing with the first and second data drivers 520A and 520B and the first and second scan drivers 530A and 530B. In more detail, the driver I/F 220 controls transmission and reception of data and various control signals between the display controller 540 and the first and second data drivers 520A and 520B and the first and second scan drivers 530A and 530B. The driver I/F 220 includes a driver signal generation section 222 which generates various display control signals to be transmitted to the first and second data drivers 520A and 520B and the first and second scan drivers 530A and 530B. The driver signal generation section 222 generates various display control signals based on a value set in the setting register section 250.

The frame memory 230 stores the grayscale data for one frame (for one vertical scan) supplied from the host 550 through the host I/F 210, for example. A value set in the setting register section 250 is set by the host 550 through the host I/F 210.

The control section 240 controls the host I/F 210, the driver I/F 220, the frame memory 230, and the setting register section 250.

In the display controller 540, the grayscale data is read from the frame memory 230 in a predetermined read cycle (every 1/160 seconds, for example), and the grayscale data is output to the data driver 520 through the driver I/F 220. Therefore, the write timing of the grayscale data from the host 550 into the frame memory 230 is asynchronous with the read timing of the grayscale data from the frame memory 230 into the data driver 520. The access control of the frame memory 230 is performed by a memory controller 242 in the control section 240.

Figure 14:
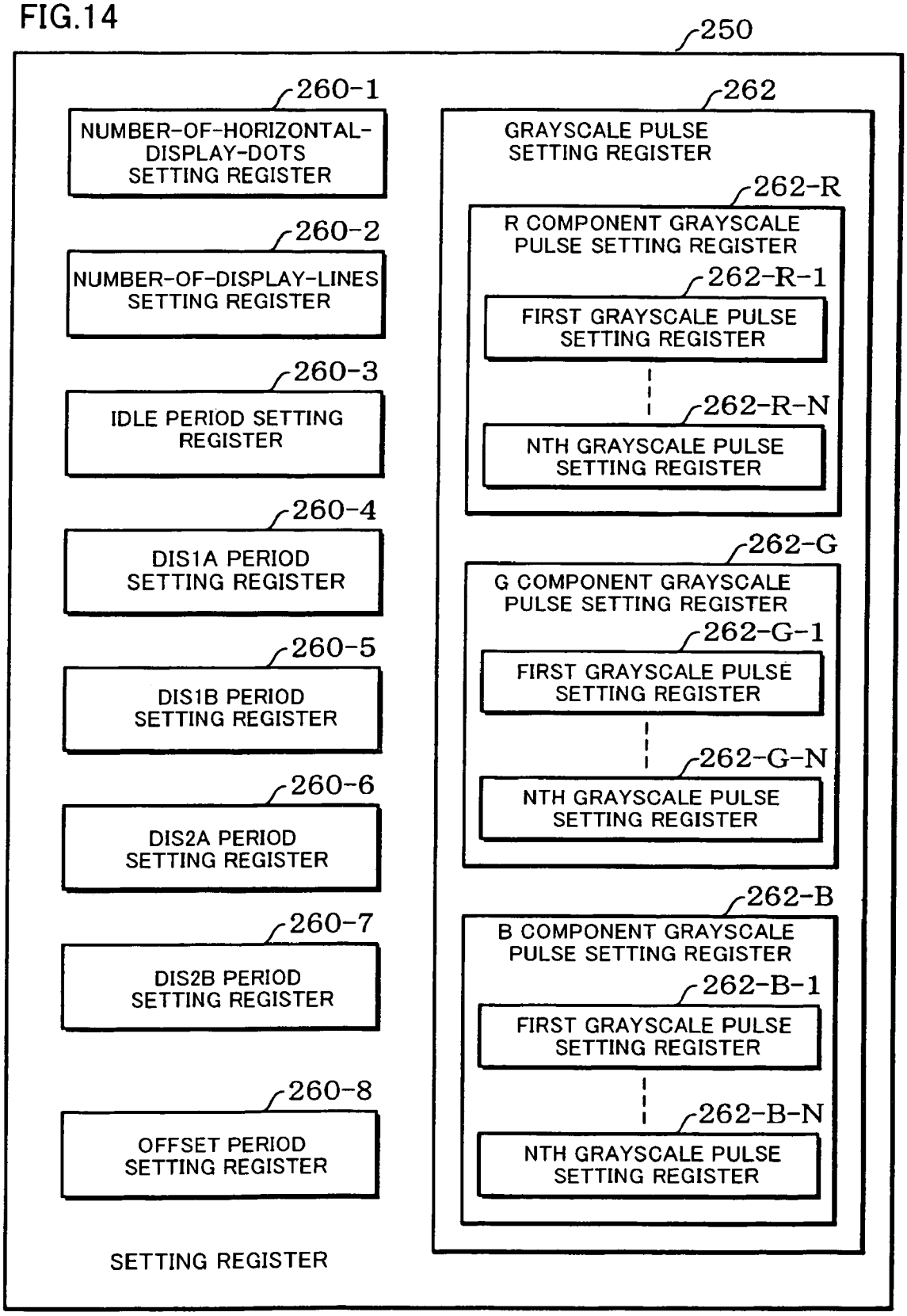
FIG. 14 is a block diagram showing a setting register section.

FIG. 14 is a block diagram showing the setting register section 250.

The number of horizontal display dots is set in a number-of-horizontal-display-dots setting register 260-1. In more detail, a value which is incremented by one in eight dot units is set in the number-of-horizontal-display-dots setting register 260-1. Therefore, the set value may be "(number of horizontal display dots/8)−1". This enables the number of bits of the number-of-horizontal-display-dots setting register 260-1 to be reduced.

The number of scan lines is set in a number-of-display-lines setting register 260-2. The number of cycles of the dot clock signal DCLK corresponding to the idle period is set in an idle period setting register 260-3. One vertical scan period can be determined based on the values set in the number-of-horizontal-display-dots setting register 260-1, the number-of-display-lines setting register 260-2, and the idle period setting register 260-3.

The number of cycles of the dot clock signal DCLK corresponding to the period Td1A from the falling edge of the first latch pulse signal LPA to the falling edge of the discharge signal DIS1A is set in a DISLA period setting register 260-4. The DISLA period setting register 260-4 corresponds to the first horizontal blanking period setting register 152 shown in FIG. 8.

The number of cycles of the dot clock signal DCLK corresponding to the period Td1B from the falling edge of the second latch pulse signal LPB to the falling edge of the discharge signal DIS1B is set in a DIS1B period setting register 260-5. The DIS1B period setting register 260-5 corresponds to the second horizontal blanking period setting register 154 shown in FIG. 8.

The number of cycles of the dot clock signal DCLK corresponding to the period Td2A from the falling edge of the first latch pulse signal LPA to the falling edge of the discharge signal DIS2A is set in a DIS2A period setting register 260-6. The DIS2A period setting register 260-6 corresponds to the first vertical blanking period setting register 156 shown in FIG. 8.

The number of cycles of the dot clock signal DCLK corresponding to the period Td2B from the falling edge of second latch pulse signal LPB to the falling edge of the discharge signal DIS2B is set in a DIS2B period setting register 260-7. The DIS2B period setting register 260-6 corresponds to the second horizontal blanking period setting register 158 shown in FIG. 8.

The number of cycles of the dot clock signal DCLK corresponding to the offset period is set in an offset period setting register 260-8. The offset period setting register 260-8 corresponds to the offset period setting register 150 shown in FIG.

8. A grayscale pulse setting register 262 corresponds to the grayscale pulse setting register 160 shown in FIG. 8.

The grayscale pulse setting register 262 includes an R component grayscale pulse setting register 262-R, a G component grayscale pulse setting register 262-G, and a B component grayscale pulse setting register 262-B. The grayscale pulse setting register for each color component is a register for setting the edges of N grayscale pulses of the R component grayscale clock signal. Therefore, the R component grayscale pulse setting register 262-R includes first to Nth grayscale pulse setting registers 262-R-1 to 262-R-N. The G component grayscale pulse setting register 262-G includes first to Nth grayscale pulse setting registers 262-G-1 to 262-G-N. The B component grayscale pulse setting register 262-B includes first to Nth grayscale pulse setting registers 262-B-1 to 262-B-N.

Figure 15:
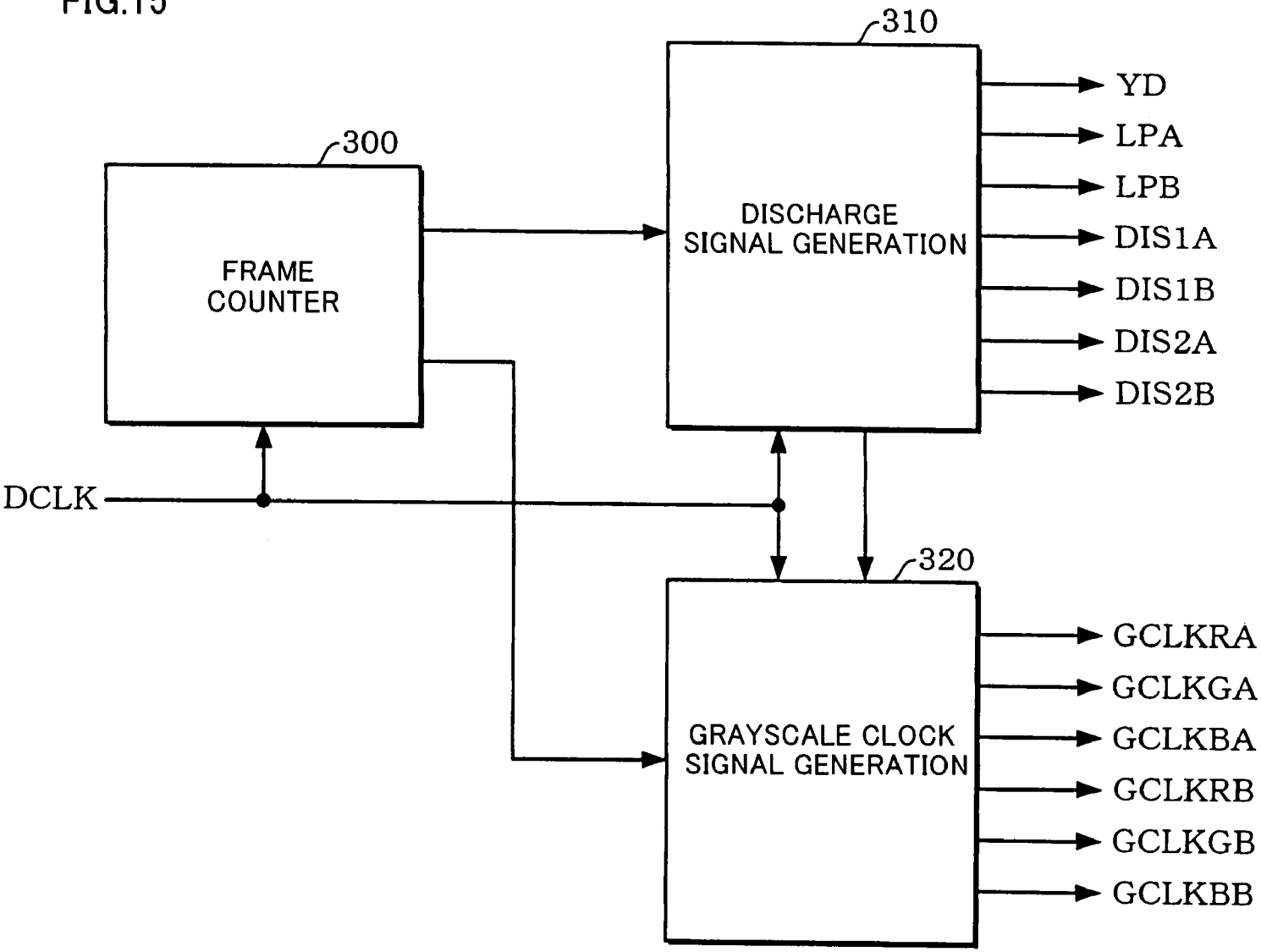
FIG. 15 is a block diagram showing a driver signal generation section.

FIG. 15 is a block diagram showing the driver signal generation section 222.

The driver signal generation section 222 includes a frame counter 300, a discharge signal generation section 310, and a grayscale clock signal generation section 320. The frame counter 300 performs a count operation for calculating the count values VCNT and HCNT. The discharge signal generation section 310 generates the vertical synchronization signal YD, the first and second latch pulse signals LPA and LPB, and the discharge signals DIS1A, DIS1B, DIS2A, and DIS2B based on the count operation of the frame counter 300. The grayscale clock signal generation section 320 generates the first and second grayscale clock signals GCLKRA to GCLKBA and GCLKRB to GCLKBB within the horizontal display period specified by the discharge signals DISLA and DIS1B.

Figure 16:
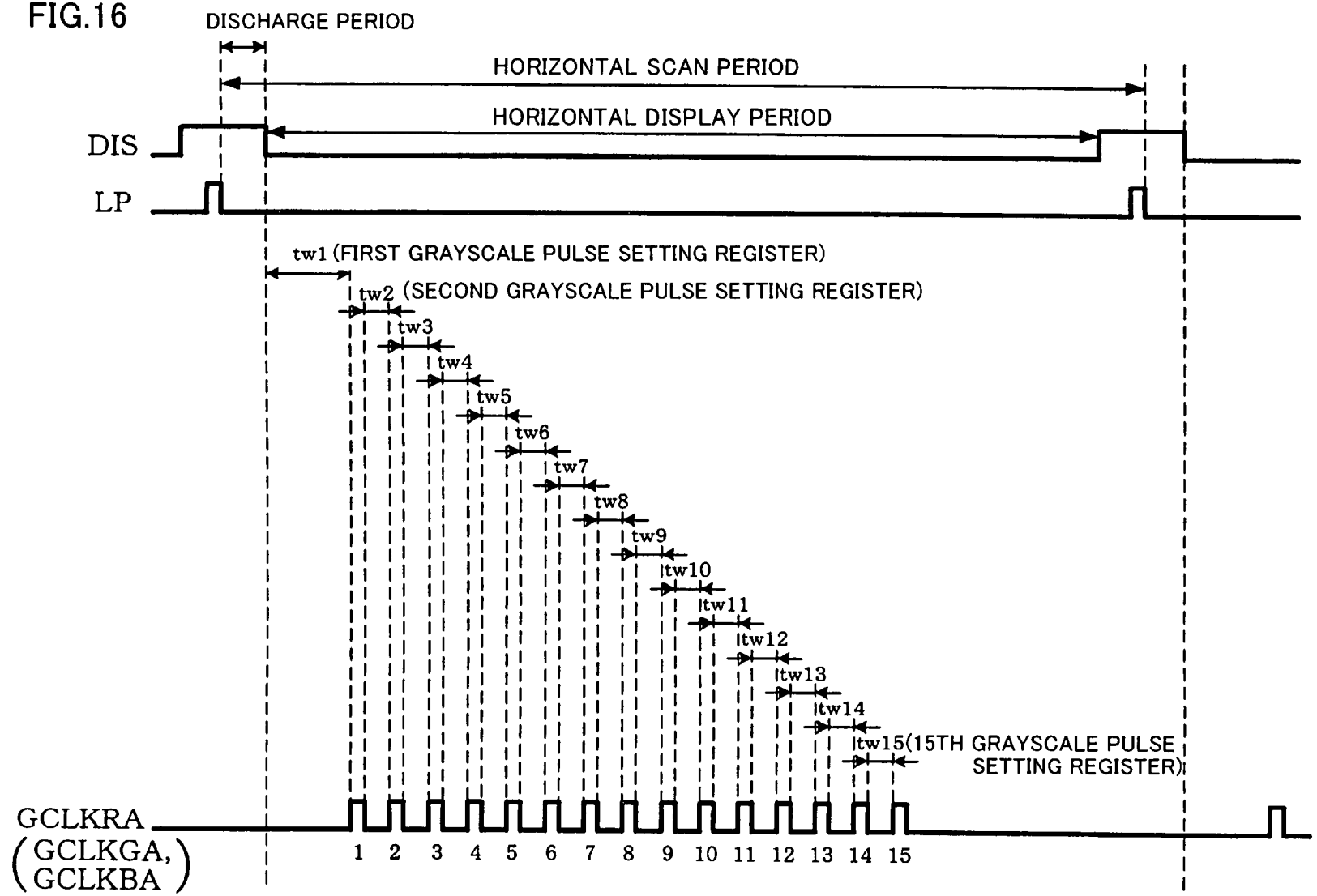
FIG. 16 is illustrative of a grayscale clock signal generated by a grayscale clock signal generation section.

FIG. 16 is illustrative of a grayscale clock signal generated by the grayscale clock signal generation section 320. FIG. 16 shows the R component grayscale clock signal GCLKRA when N is "15". However, the same description also applies to the case where N is another value or the color component is another color component.

The first grayscale pulse setting register 262-R-1 shown in FIG. 14 is a register for setting an interval tw1 between the reference timing which is the starting point of the horizontal display period and the edge (rising edge or falling edge) of the first grayscale pulse. The second grayscale pulse setting register 262-R-2 is a register for setting an interval tw2 between the edge of the first grayscale pulse and the edge of the second grayscale pulse. Specifically, the ith ($2 \leqq i \leqq N$, i is an integer) grayscale pulse setting register is a register for setting an interval tw1 between the edge of the (i−1)th grayscale pulse and the edge of the ith grayscale pulse.

Figure 17:
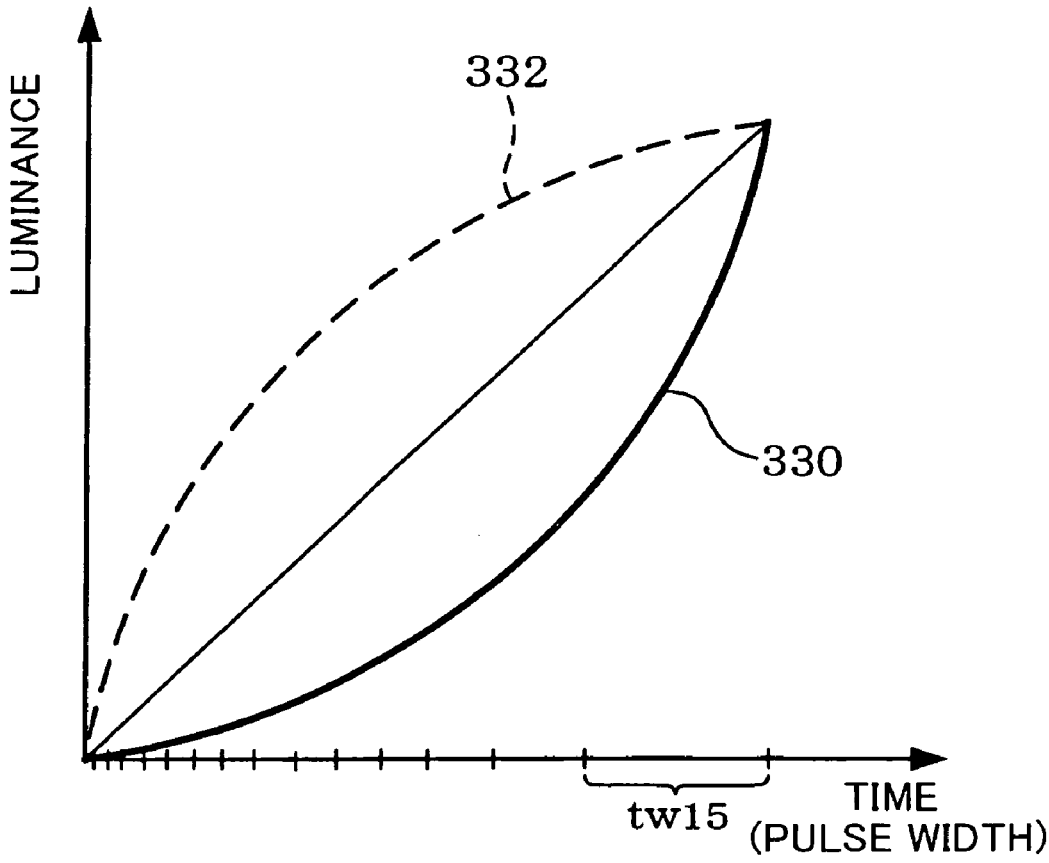
FIG. 17 is a graph showing an example of organic EL grayscale characteristics.

As described above, since the grayscale clock signal generation section 320 can separately set the timing of the edge of each grayscale pulse of the grayscale clock signal GCLK for specifying the change point of the PWM signal, gamma correction which corrects a characteristic curve 330 of the organic EL panel 510 as shown in FIG. 17 is implemented, whereby the organic EL panel 510 can be finely controlled so that characteristics such as a gamma correction curve 332 are obtained. According to the characteristic diagram shown in FIG. 17, it is necessary to increase the interval between the grayscale pulses (pulse width of the grayscale clock signal) as the luminance is increased in order to obtain luminance (grayscale) specified by discrete grayscale data.

Since the grayscale clock signals GCLKRA to GCLKBA, of which the interval between the grayscale pulses can be set, can be generated for each color component, the pulse width of the PWM signal can be caused to differ even if the value of the grayscale data is the same. This enables a desired grayscale representation to be implemented by performing fine gamma correction for each color component, even if the luminance differs to a large extent between each color component of the organic EL panel 510. Since the manufacturing technology of the organic EL panel is immature differing from the liquid crystal panel and the variation between each color component is great, it is particularly effective that fine gamma correction can be implemented for each color component.

Figure 18:
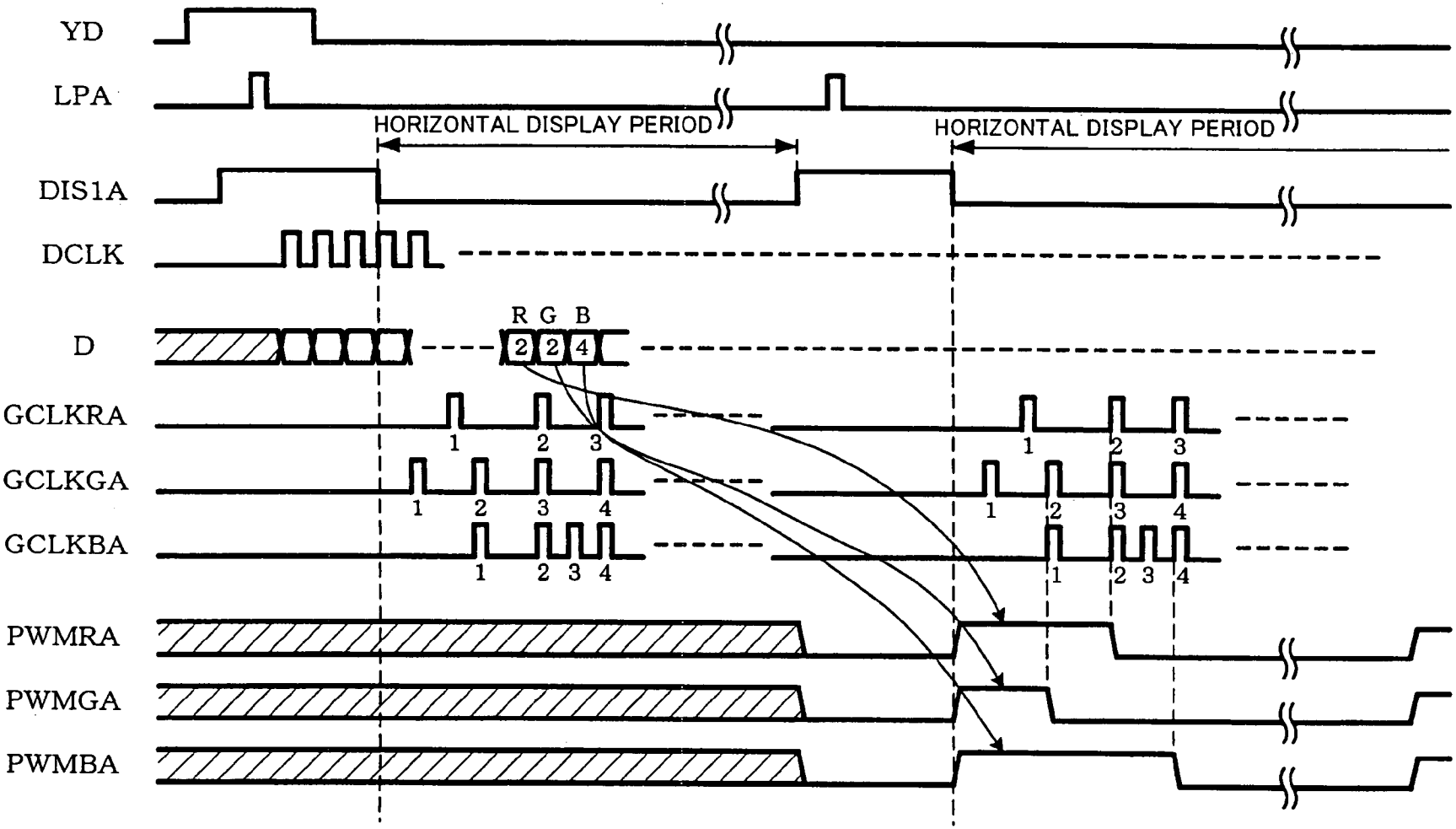
FIG. 18 is a timing chart showing an operation of generating a PWM signal using the grayscale clock signal shown in FIG. 16.

FIG. 18 is a timing chart showing an operation of generating the PWM signal using the grayscale clock signals GCLKRA to GCLKBA shown in FIG. 16.

One vertical scan period starts when the pulse of the vertical synchronization signal YD is input from the display controller 540. One horizontal scan period starts when the pulse of the horizontal synchronization signal LPA is input from the display controller 540 in a period in which the vertical synchronization signal YD is set at the H level. The horizontal display period starts based on the timing at which the discharge signal DIS1A from the display controller 540 is changed from the H level to the L level as the reference timing. The horizontal display period ends at the timing at which the discharge signal DIS1A is changed to the H level.

In the horizontal display period, the display controller 540 outputs the dot clock signal DCLK, and sequentially outputs the color component grayscale data in synchronization with the dot clock signal DCLK. The grayscale clock signal generation section 320 outputs the grayscale clock signals GCLKRA, GCLKGA, and GCLKBA within the horizontal display period based on the R component grayscale pulse setting register 262-R, the G component grayscale pulse setting register 262-G, and the B component grayscale pulse setting register 262-B.

The data driver 520 which has stored the grayscale data from the display controller 540 in the shift register latches the grayscale data in one horizontal scan unit in the line latch based on the horizontal synchronization signal LPA in a period in which the discharge signal DISLA is set at the H level. Therefore, the first data driver 520A generates PWM signals PWMRA, PWMGA, and PWMBA corresponding to the grayscale data in the horizontal scan period subsequent to the horizontal scan period in which the grayscale data from the display controller 540 is supplied. In FIG. 18, since the R component grayscale data is "2", the pulse width of the PWM signal PWMRA is a period from the falling edge of the discharge signal DIS1A to the edge of the second grayscale pulse. Since the G component grayscale data is "2", the pulse width of the PWM signal PWMGA is a period from the falling edge of the discharge signal DIS1A to the edge of the second grayscale pulse. Since the B component grayscale data is "4", the pulse width of the PWM signal PWMBA is the period from the falling edge of the discharge signal DISLA to the edge of the fourth grayscale pulse. As described above, since the interval between the grayscale pulses of the grayscale clock signal can be caused to differ for each color component, the PWM signals having different pulse widths can be generated for the color components of which the values of the grayscale data are the same.

Moreover, the horizontal display period is made variable by adjusting the horizontal blanking period using the discharge signal DIS1A, and the interval between the grayscale pulses can be caused to differ within the horizontal display period. This enables the pulse width of the PWM signal to be set as the absolute value corresponding to the size of the organic EL panel 510 and the type of the organic EL element, whereby a desired grayscale representation can be easily achieved.

FIG. 18 shows the case where the interval between the reference timing and the grayscale pulse or the interval between the grayscale pulses is set at the rising edge of each grayscale pulse. However, the interval may be set at the falling edge of the grayscale pulse.

FIGS. 16 to 18 illustrate the first grayscale clock signals GCLKRA to GCLKBA supplied to the first data driver 520A. However, the same description also applies to the second grayscale clock signals GCLKRB to GCLKBB supplied to the second data driver 520B. In FIG. 14, the edge of each pulse of the first and second grayscale clock signals GCLKRA to GCLKBA and GCLKRB to GCLKBB is set using the grayscale pulse setting register 262 shown in FIG. 14. However, the edge of each grayscale pulse may be separately set.

2.4.1 Frame Counter

Figure 19:
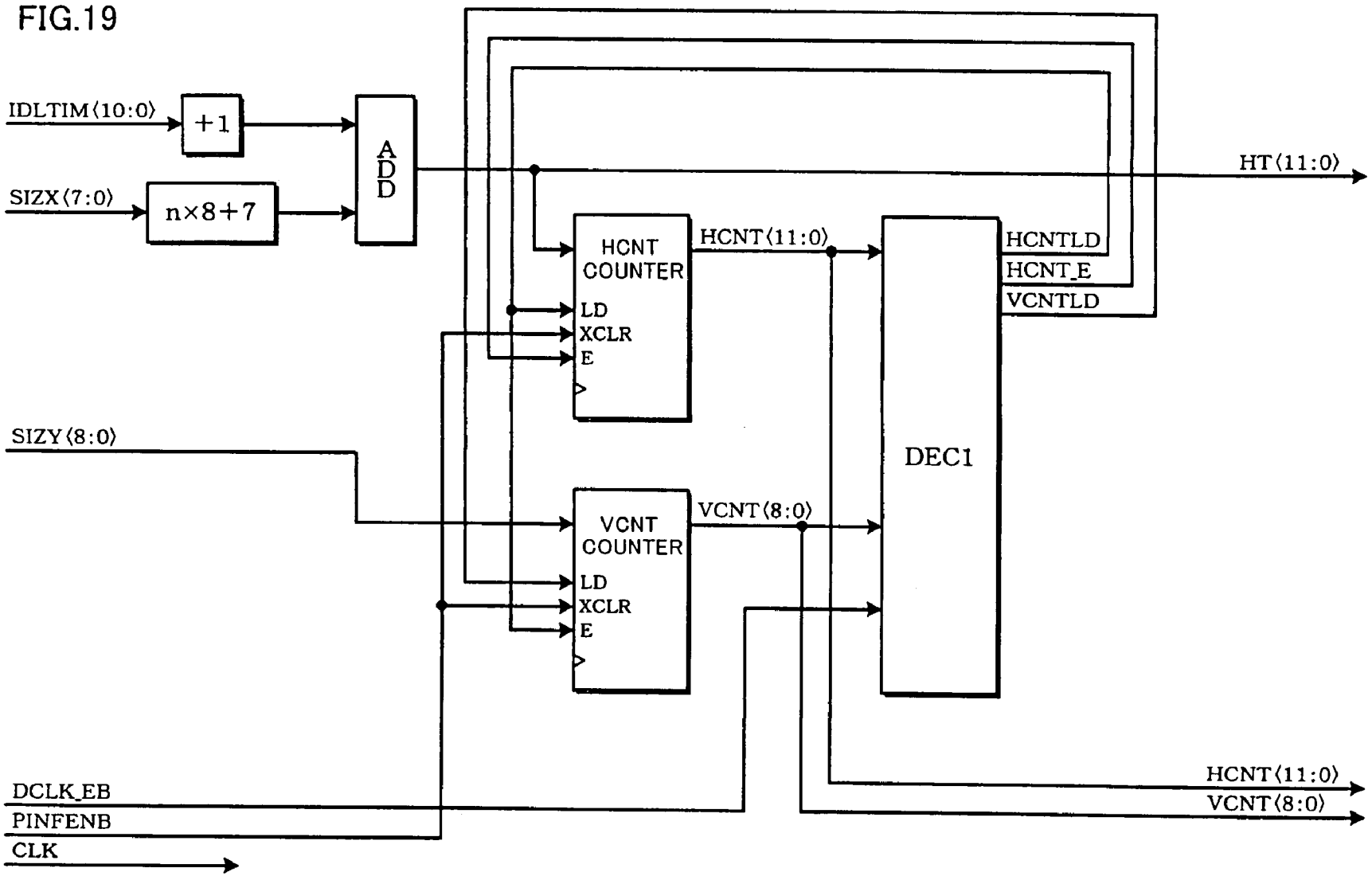
FIG. 19 is a block diagram showing a frame counter.

FIG. 19 is a block diagram showing the frame counter 300. A system clock signal CLK is supplied to each block. The dot clock signal DCLK may be a signal obtained by dividing the frequency of the system clock signal CLK.

A value IDLTIM<10:0> set in the idle period setting register 260-3, a value SIZX<7:0> set in the number-of-horizontal-display-dots setting register 260-1, and a value SIZY<8:0> set in the number-of-display-lines setting register 260-3 are input to the frame counter 300. Since the value SIZX<7:0> set in the number-of-horizontal-display-dots setting register 260-1 is designated in eight dot units, the value SIZX<7:0> is multiplied by eight, and seven is added to the resulting value. A value obtained by adding the addition result to a value obtained by adding one to the value IDLTIM<10:0> set in the idle period setting register 260-3 is a count value HT<11:0> indicating the one-line time. A signal DCLK_EB is an edge signal of the dot clock signal DCLK. An IF enable signal PINFENB is an enable signal of the driver I/F 220.

FIG. 20A shows a truth table for illustrating an operation of an HCNT counter. FIG. 20B shows a truth table for illustrating an operation of a VCNT counter. FIG. 20C shows a truth table for illustrating an operation of a decoder DEC1.

In FIG. 20A, the HCNT counter is reset when a signal input to an XRST terminal (not shown) is set at the L level (0), and operates in synchronization with the system clock signal CLK input to a CLK terminal. An initial value is loaded in synchronization with the rising edge of the system clock signal CLK when a signal input to the XRST terminal is set at the H level (1) and a signal input to an XCLR terminal is set at the L level. The value HT<11:0> is loaded in synchronization with the rising edge of the system clock signal CLK when a load signal input to an LD terminal is set at the H level (1). A count value HCNT is decremented in synchronization with the rising edge of the system clock signal CLK when the load signal is set at the L level (0) and an enable signal input to an E terminal is set at the H level.

In FIG. 20B, the truth table is expressed in the same manner as in FIG. 20A. Therefore, detailed description is omitted. In FIG. 20C, each signal shown in the column of the signal name is set at the H level when the condition is true.

Figure 21:
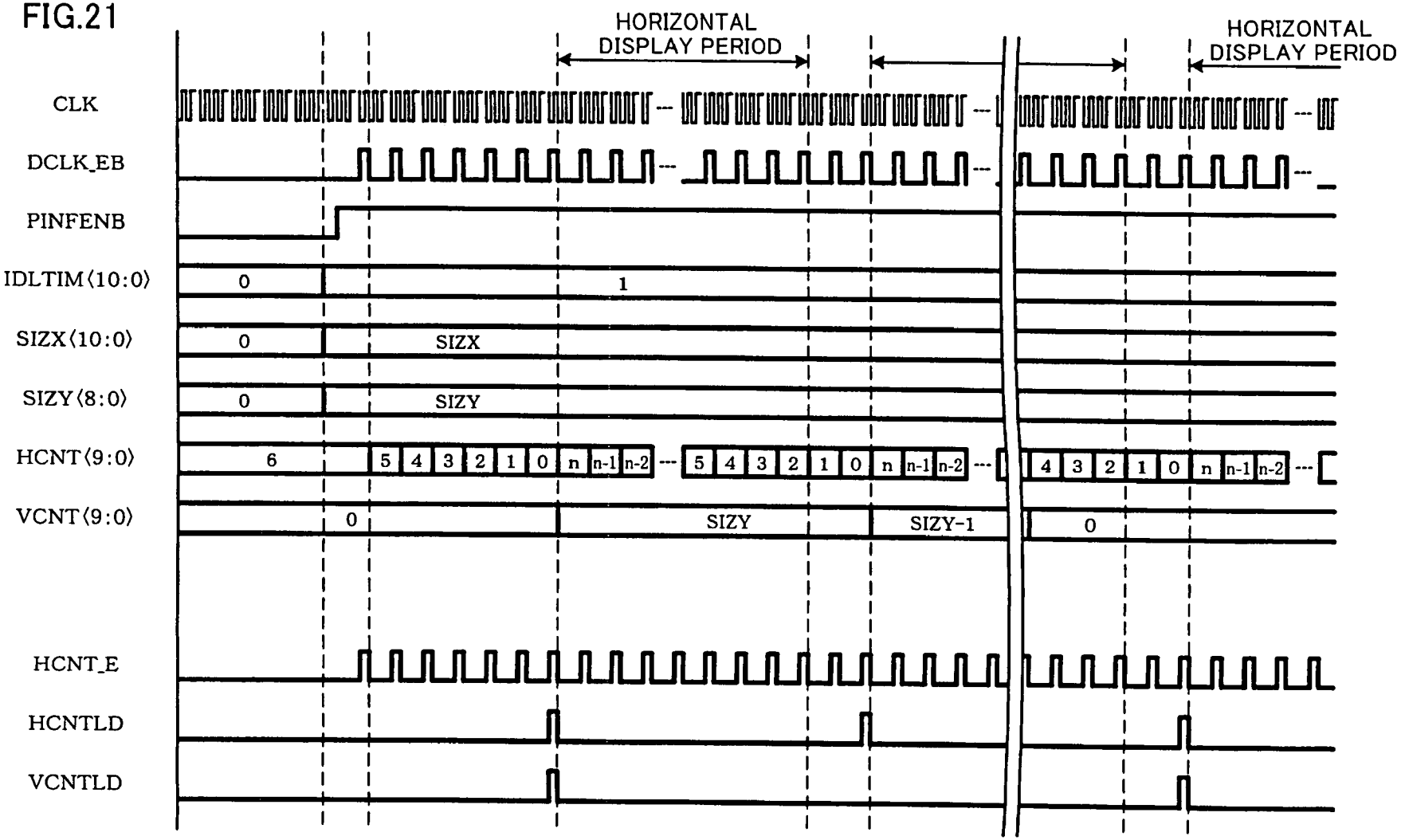
FIG. 21 is a timing chart showing an operation of the frame counter in FIG. 19.

FIG. 21 is a timing chart showing an operation of the frame counter 300 shown in FIG. 19. FIG. 21 shows the case where the value IDLTIM is "1" (idle period is "2").

The count value HCNT is decremented in synchronization with a signal HCNT_E output in units of the dot clock signal DCLK. The count value VCNT is decremented in synchronization with a signal VCNTLD. In FIG. 21, n may be "(SIZX+IDLTIM+1)".

2.4.2 Discharge Signal Generation Section

Figure 22:
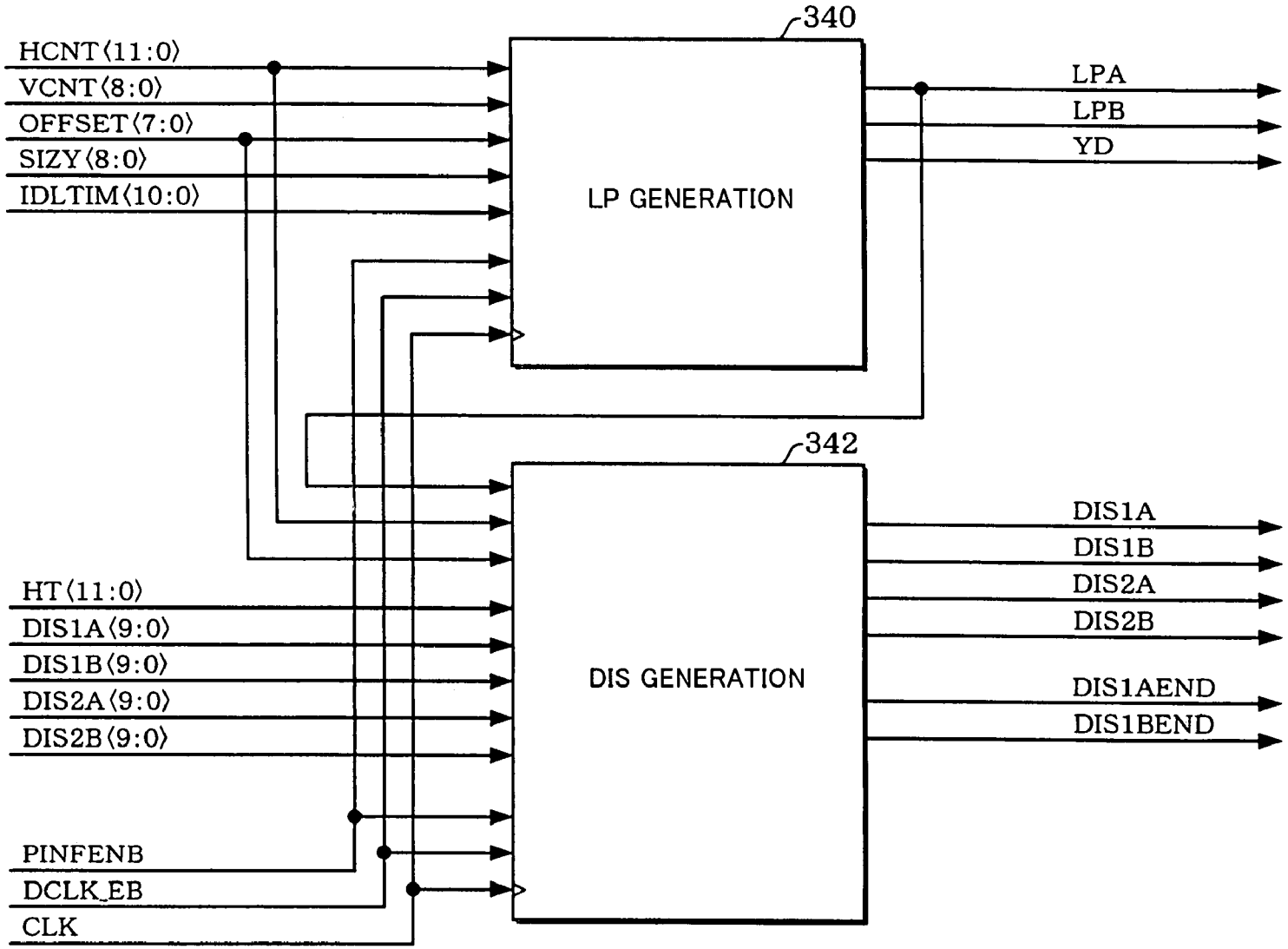
FIG. 22 is a block diagram showing a discharge signal generation section.

FIG. 22 is a block diagram showing the discharge signal generation section 310. The system clock signal CLK is supplied to each block.

The value IDLTIM<10:0> set in the idle period setting register 260-3, the value SIZY<7:0> set in the number-of-display-lines setting register 260-2, and a value OFFSET<7:0> set in the offset period setting register 260-8 are input to the discharge signal generation section 310. A value DIS1A<9:0> set in the DIS1A period setting register 260-4, a value DIS1B<9:0> set in the DIS1B period setting register 260-5, a value DIS2A<9:0> set in the DIS2A period setting register 260-6, and a value DIS2B<9:0> set in the DIS2B period setting register 260-7 are input to the discharge signal generation section 310. The count value HCNT<11:0>, the count value VCNT<8:0>, and the count value HT<11:0> of the one-line time are input to the discharge signal generation section 310.

The discharge signal generation section 310 includes an LP generation section 340 and a DIS generation section 342. The LP generation section 340 generates the first and second latch pulse signals LPA and LPB and the vertical synchronization signal YD. The DIS generation section 342 generates the discharge signals DIS1A, DIS1B, DIS2A, and DIS2B.

Figure 23:
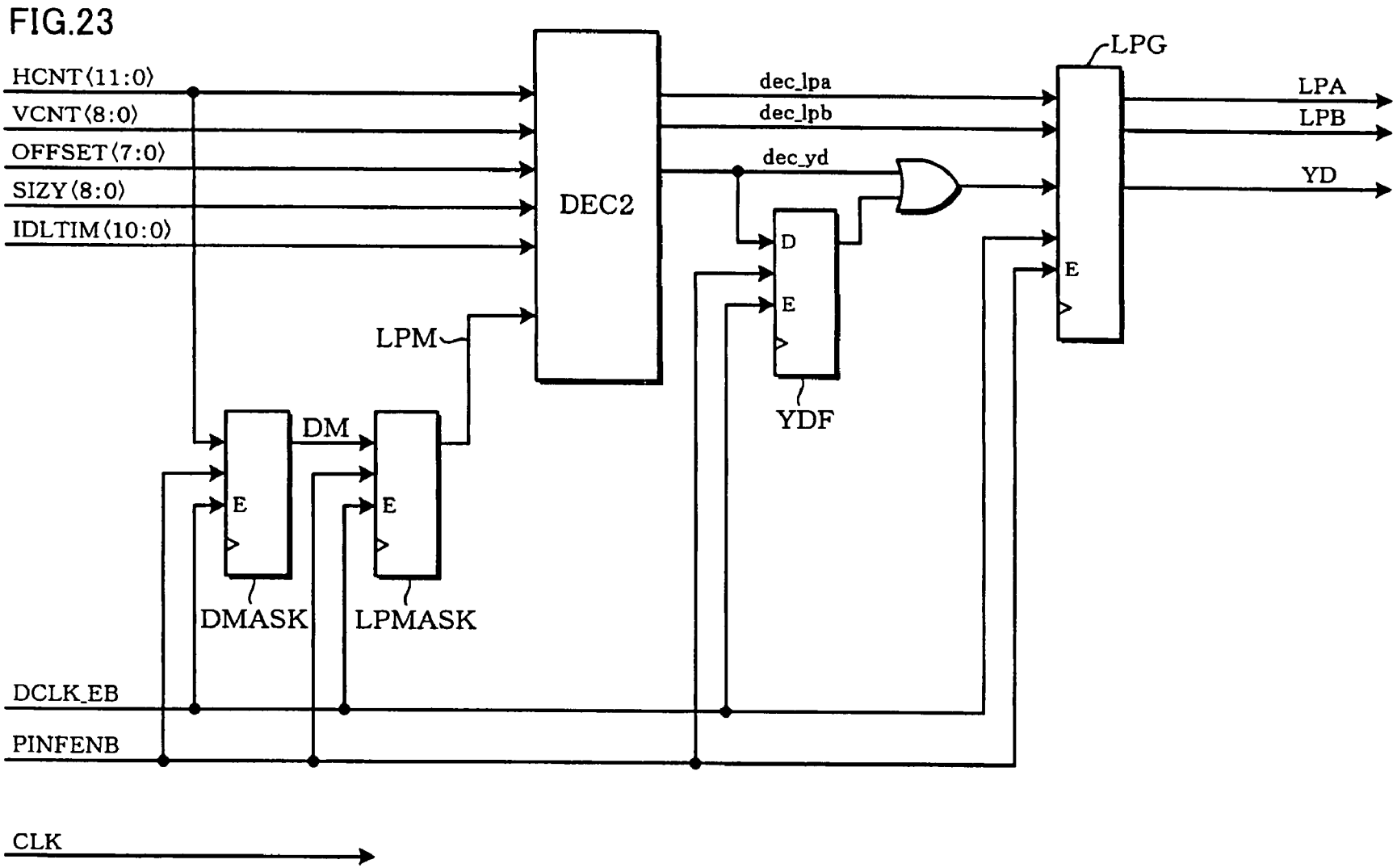
FIG. 23 is a block diagram showing an LP generation section.

FIG. 23 is a block diagram showing the LP generation section 340. The system clock signal CLK is supplied to each block.

In the LP generation section 340, a signal DM generated by a DCLK mask generation circuit DMASK is supplied to an LP mask generation circuit LPMASK. A signal LPM generated by the LP mask generation circuit LPMASK is input to a decoder DEC2. An output from the decoder DEC2 is retimed by an LP generation circuit LPG.

FIG. 24A shows a truth table for illustrating an operation of the DCLK mask generation circuit DMASK. FIG. 24B shows a truth table for illustrating an operation of the LP mask generation circuit LPMASK. FIG. 24C shows a truth table for illustrating an operation of the decoder DEC2.

In FIGS. 24A and 24B, the DCLK mask generation circuit DMASK and the LP mask generation circuit LPMASK are reset when a signal input to an XRESET terminal (not shown) is set at the L level, and operate in synchronization with the rising edge of the system clock signal CLK. The DCLK mask generation circuit DMASK sets the signal DM to "1" when the count value HCNT is "1" and the signal DCLK_EB is set at the H level. The LP mask generation circuit LPMASK sets the signal LPM to "1" when the signal DM is "1" and the signal DCLK_EB is set at the H level.

The decoder DEC2 sets a signal dec_lpa at the H level when the count value HCNT is "1" and the signal LPM is "0". The decoder DEC2 sets a signal dec_lpb at the H level when the count value HCNT is equal to or less than the value OFFSET and the signal LPM is "0". Therefore, the signals Dec_lpa and dec_lpb of which the rising timings differ for the value OFFSET and the fall timings are the same can be generated. The decoder DEC2 sets a signal dec_yd at the H level when the count value HCNT is equal to or less than the value IDLTIM and the count value VCNT is equal to the value SIZY.

A flip-flop YDF is cleared when the signal PINFENB is set at the L level. The H level period is increased for one cycle of the signal DCLK_EB by the logical OR of the output from the flip-flop YDF and the signal dec_yd.

The LP generation circuit LPG is cleared when the signal PINFENB is set at the L level. The signals dec_lpa and dec_lpb and the above logical OR result are retimed in synchronization with the signal DCLK_EB.

Figure 25:
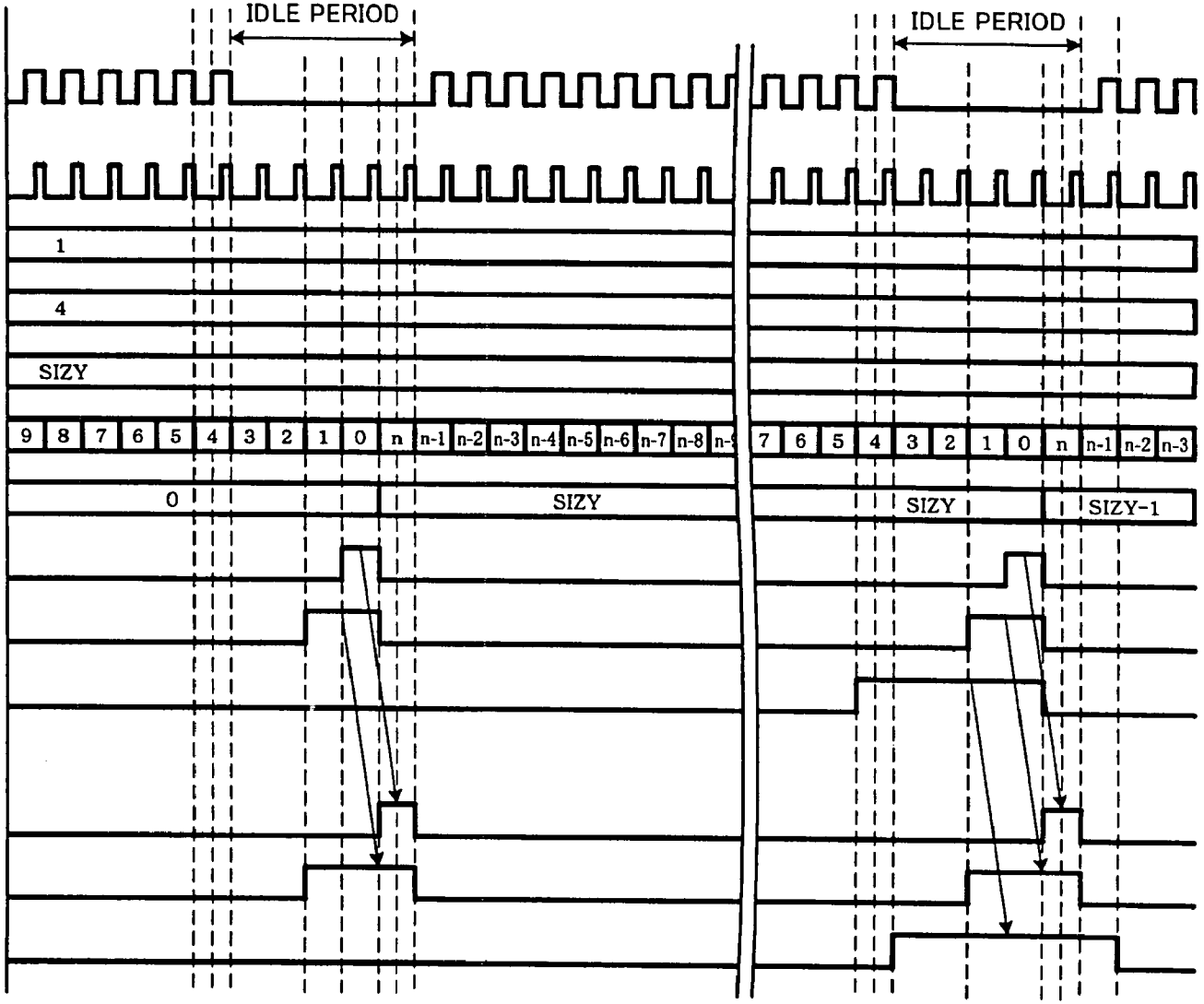
FIG. 25 is a timing chart showing an operation of the LP generation section shown in FIG. 23.

FIG. 25 is a timing chart showing an operation of the LP generation section 340 shown in FIG. 23. FIG. 25 shows the case where the value IDLTIM is "4" (idle period is "5") and the value OFFSET is "1". In FIG. 25, the LP generation circuit LPG retimes the second latch pulse signal LPB so that the signal dec_lpb at the H level is output as is.

Figure 26:
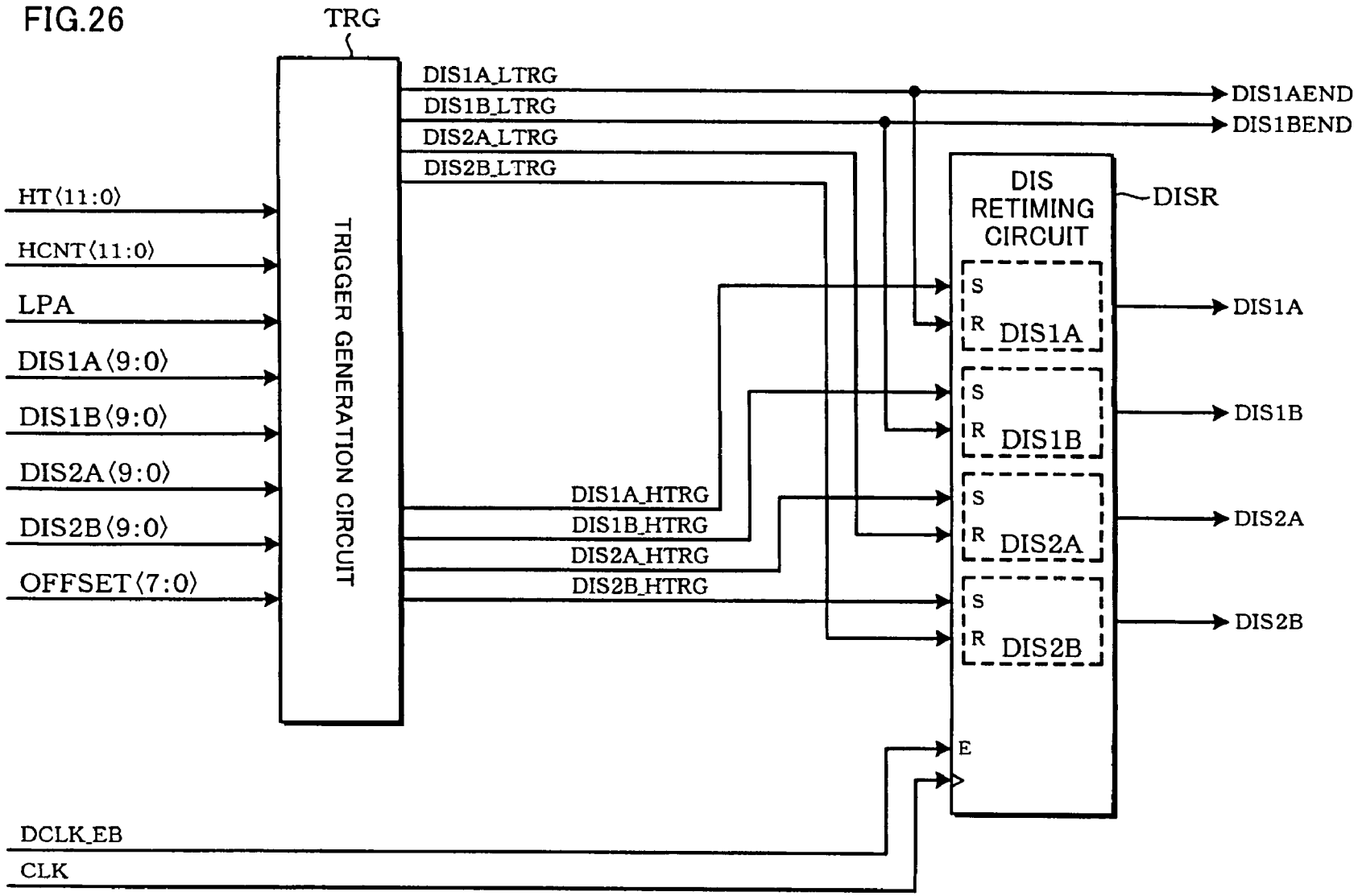
FIG. 26 is a block diagram showing a DIS generation section.

FIG. 26 is a block diagram showing the DIS generation section 342. The system clock signal CLK is supplied to each block.

The DIS generation section 342 includes a trigger generation circuit TRG and a DIS retiming circuit DISR. The trigger generation circuit TRG generates triggers for setting the discharge signals DISLA, DIS1B, DIS2A, and DIS2B at the H level or the L level based on the count values HT<11:0> and HCNT<11:0>, the first latch pulse signal LPA, and the values DIS1A<9:0>, DIS1B<9:0>, DIS2A<9:0>, and DIS2B<9:0> set in the discharge period setting registers.

FIG. 27 shows a truth table for illustrating an operation of the trigger generation circuit TRG. In FIG. 27, each signal shown in the column of the signal name is set at the H level when the condition is true. For example, a signal DIS1A_LTRG is set at the H level when the difference between the count value HT of the one-line time and the value DIS1A set in the DIS1A period setting register 260-4 coincides with the count value HCNT. The signal DIS1A_LTRG is a trigger for resetting the discharge signal DIS1A to the L level. Signals DIS1B_LTRA, DIS2A_LTRG, and DIS2B_LTRG are output in the same manner as the signal DIS1A_LTRG. Signals DIS1A_HTRG, DIS1B_HTRG, DIS2A_HTRG, and DIS2B_HTRG which are triggers for setting the discharge signals at the H level are output in the same manner as the signal DIS1A_LTRG.

Figure 28:
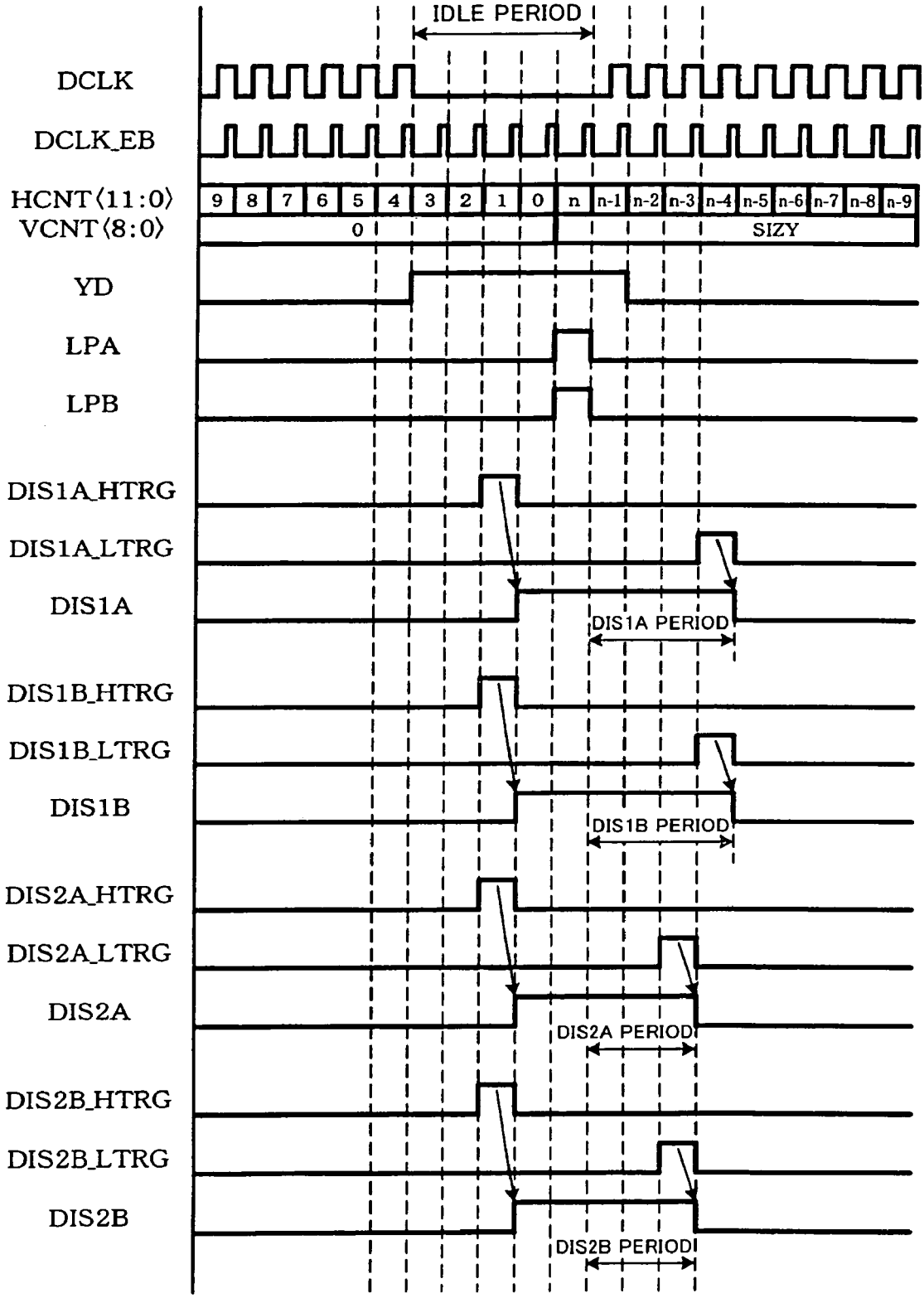
FIG. 28 is a timing chart showing an operation of the DIS generation section when an offset period is "0".

The DIS retiming circuit DISR outputs the discharge signal DISLA which is set by the signal DIS1A_HTRG in synchronization with the signal DCLK_EB and is reset by the signal DIS1A_LTRG. The DIS retiming circuit DISR outputs the discharge signal DIS1B which is set by the signal DIS1B_HTRG in synchronization with the signal DCLK_EB and is reset by the signal DIS1B_LTRG. The DIS retiming circuit DISR outputs the discharge signal DIS2A which is set by the signal DIS2A_HTRG in synchronization with the signal DCLK_EB and is reset by the signal DIS2A_LTRG. The DIS retiming circuit DISR outputs the discharge signal DIS2B which is set by the signal DIS2B_HTRG in synchronization with the signal DCLK_EB and is reset by the signal DIS2B_LTRG FIG. 28 is a timing chart showing an operation of the DIS generation section 342 when the offset period is "0". In FIG. 28, the idle period is "5", the offset period is "0", the value DIS1A<9:0> set in the DIS1A period setting register 260-4 is "4", the value DIS1B<9:0> set in the DIS1B period setting register 260-5 is "4", the value DIS2A<9:0> set in the DIS2A period setting register 260-6 is "3", and the value DIS2B<9:0> set in the DIS2B period setting register 260-7 is "3".

Figure 29:
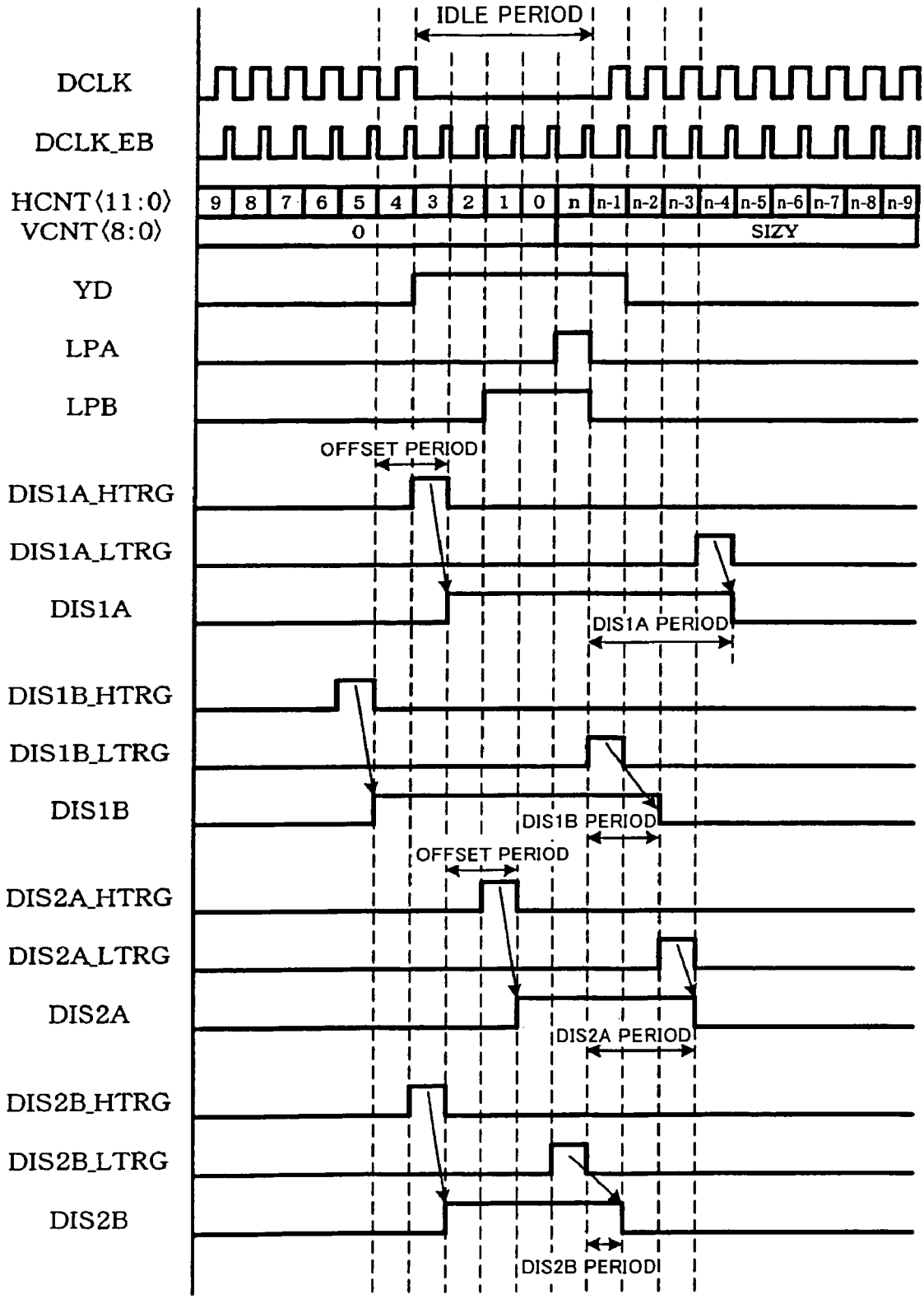
FIG. 29 is a timing chart showing an operation of the DIS generation section when an offset period is "2".

FIG. 29 is a timing chart showing an operation of the DIS generation section 342 when the offset period is "2".

As shown in FIGS. 28 and 29, the generation timings of the triggers for setting the discharge signals DIS1B and DIS2B at the H level are determined corresponding to the value set in the offset period setting register. The generation timings of the triggers for setting the discharge signals DIS1B and DIS2B at the L level are determined corresponding to the value set in the DIS1B and DIS2B period setting registers. The discharge signals DIS1B and DIS2B can be respectively changed before the discharge signals DIS1A and DIS2A by changing the timings of the triggers for setting the discharge signals DIS1B and DIS2B at the H level.

2.4.3 Grayscale Clock Signal Generation Section

Figure 30:
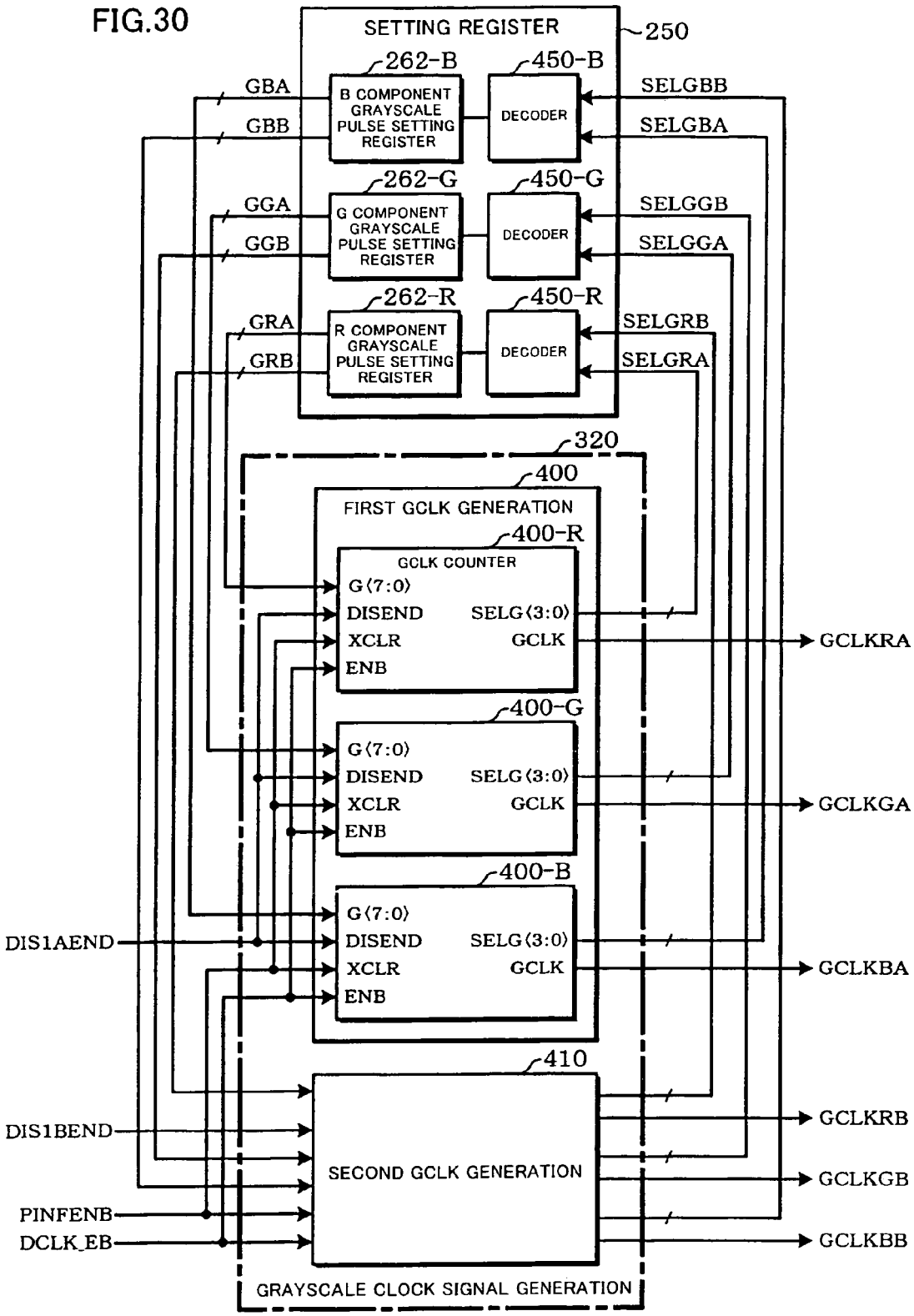
FIG. 30 is a block diagram showing a grayscale clock signal generation section.

FIG. 30 is a block diagram showing the grayscale clock signal generation section 320. The system clock signal CLK (not shown) is input to each section of the grayscale clock signal generation section 320, and each section operates in synchronization with the system clock signal CLK.

The grayscale clock signal generation section 320 includes a first GCLK generation section 400 and a second GCLK generation section 410. The first GCLK generation section 400 includes a GCLK counter 400-R which functions as an R component grayscale clock signal generation section, a GCLK counter 400-G which functions as a G component grayscale clock signal generation section, and a GCLK counter 400-B which functions as a B component grayscale clock signal generation section. The GCLK counters 400-R to 400-B have the same configuration.

The second GCLK generation section 410 has a configuration the same as the configuration of the first GCLK generation section 400. Specifically, the second GCLK generation section 410 includes a GCLK counter 410-R (not shown) which functions as an R component grayscale clock signal generation section, a GCLK counter 410-G (not shown) which functions as a G component grayscale clock signal generation section, and a GCLK counter 410-B (not shown) which functions as a B component grayscale clock signal generation section.

Data GRA<7:0> set in one of the first to fifteenth grayscale pulse setting registers 262-R-1 to 262-R-15 of the R component grayscale pulse setting register 262-R is input to the GCLK counter 400-R. A discharge end signal DIS1AEND indicating the falling edge of the discharge signal DIS1A, the IF enable signal PINFENB which is the enable signal of the driver I/F 220, and the DCLK edge signal DCLK_EB indicating the falling edge of the dot clock signal DCLK are input to the GCLK counter 400-R. The GCLK counter 400-R outputs the R component grayscale clock signal GCLKRA and a signal SELGRA<3:0> for selecting the next grayscale pulse setting register.

The GCLK counters 400-G and 400-B are the same as the GCLK counter 400-R, to which the G component or B component signal is input and which output the G component or B component signal instead of the R component signal. Therefore, description of the GCLK counters 400-G and 400-B is omitted.

The GCLK counter 410-R, the GCLK counter 410-G, and the GCLK counter 410-B of the second GCLK generation section 410 are the same as those of the GCLK counter 400-R. Therefore, description of these counters is omitted. However, a discharge end signal DIS1BEND indicating the falling edge of the discharge signal DIS1B is input to the second GCLK generation section 410 instead of the discharge end signal DIS1AEND.

The discharge end signals DIS1AEND and DIS1BEND are generated by the DIS generation section 342 shown in FIG. 26.

Figure 31:
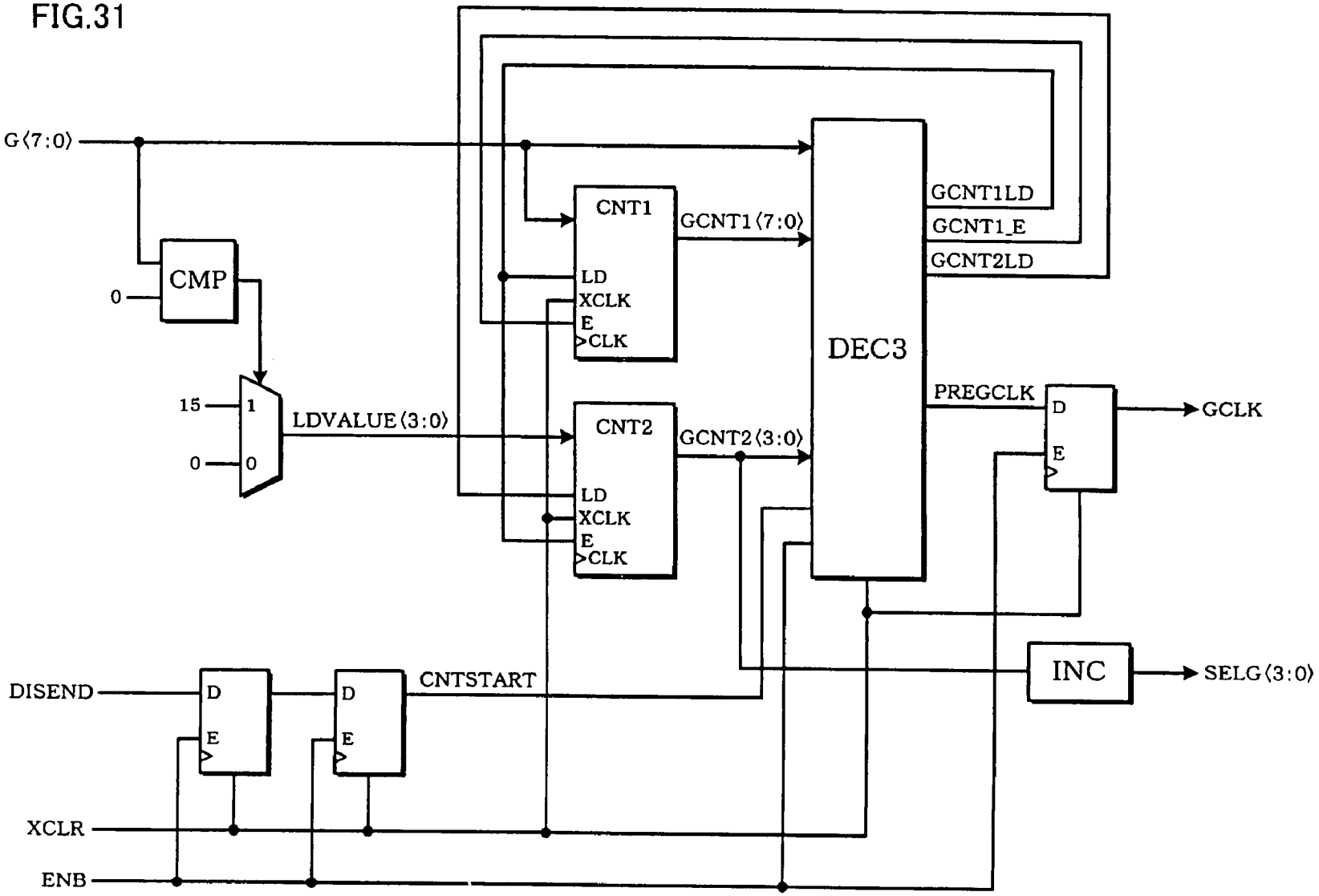
FIG. 31 is a block diagram showing the GCLK counter shown in FIG. 30.

FIG. 31 is a block diagram showing the GCLK counter.

The GCLK counter shown in FIG. 31 has a configuration the same as the configurations of the GCLK counters 400-R, 400-G, 400-B, 410-R, 410-G, and 410-B shown in FIG. 30. The system clock signal CLK is input to each circuit section shown in FIG. 31, and the internal state of each circuit section is initialized by a clear signal XCLR.

The GCLK counter includes a pulse width counter CNT1 and a grayscale counter CNT2. The pulse width counter CNT1 counts the interval until occurrence of the edge of the next grayscale pulse by decrementing the set data G<7:0>. Specifically, the pulse width counter CNT1 outputs the grayscale pulse so that the edge of the next grayscale pulse occurs when the data G<7:0> set in the grayscale pulse setting register is decremented to "0".

FIG. 32A shows a truth table for an operation of the pulse width counter CNT1.

FIG. 32A shows that the pulse width counter CNT1 operates in synchronization with the system clock signal CLK (not shown) input to a CLK terminal. For example, the set data G<7:0> is loaded in synchronization with the rising edge of the system clock signal CLK when a load signal input to an LD terminal is set at the H level (1). A count value GCNT1<7:0> is decremented in synchronization with the rising edge of the system clock signal CLK when the load signal is set at the L level (0) and an enable signal input to an E terminal is set at the H level, for example.

In FIG. 31, the grayscale counter CNT2 is a counter for specifying the current grayscale pulse. Specifically, the grayscale counter CNT2 increments a count value GCNT2<3:0> which is the pulse number for specifying the current grayscale pulse, and stops outputting the grayscale pulse when the count value GCNT2<3:0> has become "15". The set data of the pulse number decremented by the pulse width counter CNT1 is specified by the count value GCNT2<3:0>.

FIG. 32B shows a truth table for an operation of the grayscale counter CNT2. FIG. 32B shows that the grayscale counter CNT2 operates in synchronization with the system clock signal CLK (not shown) input to a CLK terminal. For example, a load value LDVALUE<3:0> is loaded in synchronization with the rising edge of the system clock signal CLK when a load signal input to an LD terminal is set at the H level (1). The count value GCNT2<3:0> is incremented in synchronization with the rising edge of the system clock signal CLK when the load signal is set at the L level and an enable signal input to an E terminal is set at the H level, for example.

The pulse width counter CNT1 and the grayscale counter CNT2 are enable-controlled and load-controlled by a decoder DEC3.

The count value GCNT1<7:0> from the pulse width counter CNT1, the count value GCNT2<3:0> from the grayscale counter CNT2, the enable signal ENB, a count start signal CNTSTART, and the like are input to the decoder DEC3. The decoder DEC3 outputs a pulse width counter load signal GCNT1LD, a pulse width counter enable signal GCNT1_E, a grayscale counter load signal GCNT2LD, and a pre-grayscale clock signal PREGCLK. The pulse width counter load signal GCNT1LD is supplied to the LD terminal of the pulse width counter CNT1 and the E terminal of the grayscale counter CNT2. The pulse width counter enable signal GCNT1_E is supplied to the E terminal of the pulse width counter CNT1. The grayscale counter load signal GCNT2LD is supplied to the LD terminal of the grayscale counter CNT2.

FIG. 32C shows a truth table for an operation of the decoder DEC3. In FIG. 32C, each signal shown in the column of the signal name is set at the H level when the condition is true.

The pulse width counter load signal GCNT1LD is set at the H level when the count start signal CNTSTART is set at the H level, or when the count value GCNT2 is not "15", the count value GCNT1 is "0", and the enable signal ENB is set at the H level. In this case, the pulse width counter CNT1 loads the data G<7:0>, and the grayscale counter CNT2 increments the count value GCNT2<3:0>.

The pulse width counter enable signal GCNT1_E is set at the H level when the count value GCNT2 is not "15" and the enable signal ENB is set at the H level. In this case, the pulse width counter CNT1 decrements the count value GCNT1<3:0>.

The pulse width counter load signal GCNT2LD is set at the H level when the count start signal CNTSTART is set at the H level, or when the count value GCNT1 is "0", the data G<7:0> is "0", and the enable signal ENB is set at the H level. In this case, the grayscale counter CNT2 loads the load value LDVALUE<3:0>.

The pre-grayscale clock signal PREGCLK is set at the H level when the count value GCNT1<7:0> is "1".

As described above, the decoder DEC3 updates the pulse width counter load signal GCNT1LD, the pulse width counter enable signal GCNT1_E, and the grayscale counter load signal GCNT2LD when the enable signal ENB is set at the H level. Since the enable signal ENB of the decoder DEC3 is the DCLK edge signal DCLK_EB, the pulse width counter CNT1 is decremented in units of the dot clock signal DCLK. Specifically, the GCLK counter shown in FIG. 31 can output the grayscale clock signal GCLK of which the position of the edge can be adjusted in units of the dot clock signal DCLK.

Figure 33:
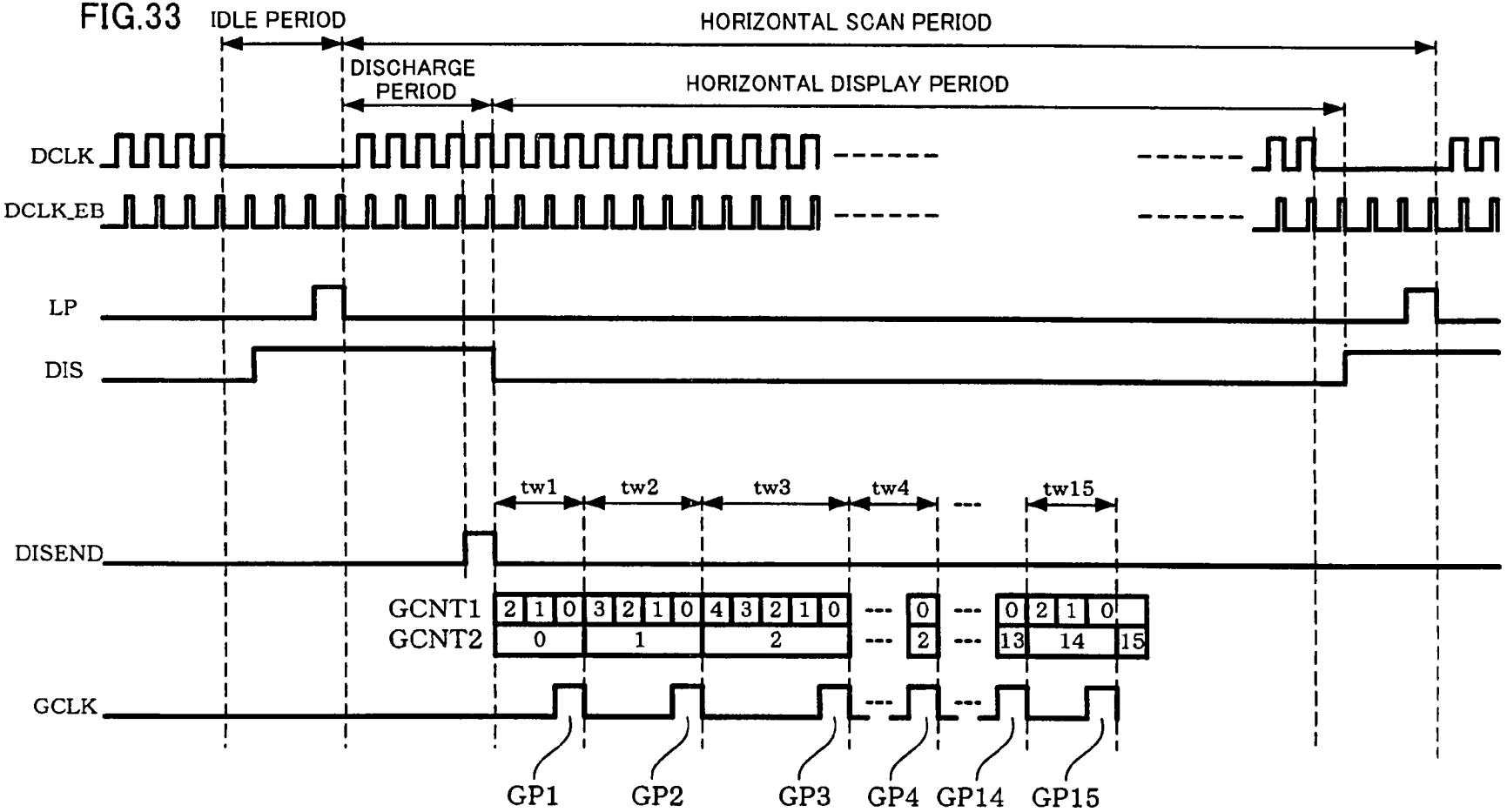
FIG. 33 is a timing chart showing an operation of a grayscale clock signal generation section.

FIG. 33 is a timing chart showing an operation of the grayscale clock signal generation section 320 shown in FIGS. 30, 31, and 32A to 32C. In FIG. 33, the interval between the reference timing and the grayscale pulse or the interval between the grayscale pulses is set at the rising edge of the grayscale pulse.

In each GCLK counter, the count start signal CNTSTART is set at the H level when the discharge end signal DISEND is set at the H level based on the falling edge of the discharge signal. The data G<7:0> set in the first pulse width setting register is loaded into the pulse width counter CNT1. The pulse width counter CNT1 decrements the count value GCNT1<7:0> when the DCLK edge signal DCLK_EB (enable signal ENB) is set at the H level. The decoder DEC3 sets the pre-grayscale clock signal PREGCLK at the H level when the count value GCNT1<7:0> is "1".

The value set in the second grayscale pulse setting register is loaded into the pulse width counter CNT1 on condition that the count value GCNT1<7:0> has become "0". At the same time, the grayscale counter CNT2 increments the count value GCNT2<3:0>.

The pre-grayscale clock signal PREGCLK is retimed by the retiming circuit, and is output as the grayscale clock signal GCLK.

The count value GCNT2<3:0> is incremented by an incrementer INC and is supplied to the setting register section 250 as a signal SELG<3:0>. In FIG. 30, upon receiving a signal SELGRA<3:0> from the GCLK counter 400-R or a signal SELGRB<3:0> from the GCLK counter 410-R, the setting register section 250 analyzes the grayscale pulse setting register specified by the signal SELGRA<3:0> or SELGRB<3:0> using the decoder 450-R, and returns the data set in the grayscale pulse setting register to the GCLK counter 400-R or the GCLK counter 410-R as GR<7:0> or GRB<7:0>.

The GCLK counter performs the above-described operation in units of one horizontal scan period.

In the GCLK counter, an output from a comparator CMP is set at the H level when the set data G<7:0> is "0". The load value LDVALUE<3:0> becomes "15" when the output from the comparator CMP is set at the H level. Therefore, the grayscale counter CNT2 stops outputting the subsequent grayscale pulse. Specifically, when the value set in the pth ($1 \leqq p \leqq N-1$, p is an integer) grayscale pulse setting register is a predetermined value ("0", for example), generation of the (p+1)th to Nth grayscale pulses is omitted.

In FIG. 30, since the R component grayscale pulse setting register 262-R is used by the first and second GCLK generation sections 400 and 410, the value GRA<7:0> is the same as the value GRB<7:0>. Since the G component grayscale pulse setting register 262-G is used by the first and second GCLK generation sections 400 and 410, the value GGA<7:0> is the same as the value GGB<7:0>. Since the B component grayscale pulse setting register 262-B is used by the first and second GCLK generation sections 400 and 410, the value GBA<7:0> is the same as the value GBB<7:0>.

Figure 34:
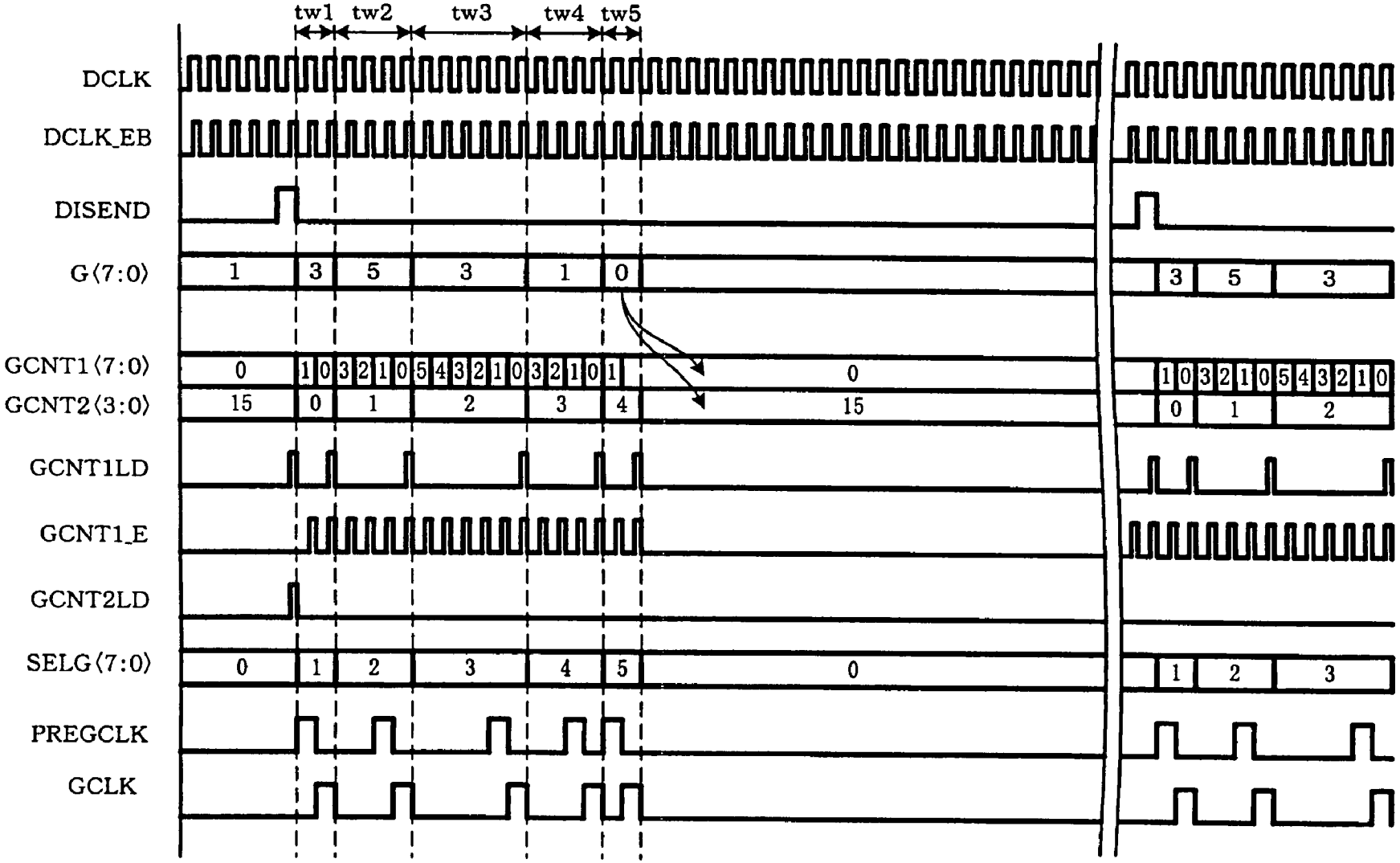
FIG. 34 is a timing chart showing an operation when output of grayscale pulses is omitted.

FIG. 34 is a timing chart showing an operation when output of the grayscale pulses is omitted.

FIG. 34 shows an operation when the value set in the fifth grayscale pulse setting register is "0". Specifically, since the value set in the fifth grayscale pulse setting register is "0" when the count value GCNT2<3:0> is "4", output of the sixth to fifteenth grayscale pulses is omitted. This enables the present invention to be applied to the case where it suffices that the number of grayscale levels be small.

The present invention is not limited to the above-described embodiments. Various modifications and variations are possible within the spirit and scope of the invention. For example, the present invention may be applied not only to drive the organic EL panel, but also to drive an electroluminescent panel, a liquid crystal display panel, or a plasma display device.

In the above-described embodiments, the display controller outputs two latch pulse signals, two horizontal blanking adjustment signals, two vertical blanking adjustment signals, or two grayscale clock signals between which the phase difference can be adjusted. However, the present invention is not limited thereto. For example, the display controller may output three or more of the above signals or clock signals among which the phase difference can be adjusted.

Part of requirements of any claim of the present invention could be omitted from a dependent claim which depends on that claim. Moreover, part of requirements of any independent claim of the present invention could be made to depend on any other independent claim.

Although only some embodiments of the present invention have been described in detail above, those skilled in the art will readily appreciate that many modifications are possible in the embodiments without departing from the novel teachings and advantages of this invention. Accordingly, all such modifications are intended to be included within the scope of this invention.

What is claimed is:

1. A display controller used for controlling first and second data drivers driving a plurality of data lines of a display panel, the display panel having a plurality of scan lines in addition to the data lines, and the display controller comprising:

a latch pulse signal generation section that generates first and second latch pulse signals having pulses, the pulses specifying one horizontal scan period; and an offset period setting register, a phase difference between the first and second latch pulse signals being set in the offset period setting register, the second latch pulse signal changing earlier than the first latch pulse signal by a period corresponding to the phase difference set in the offset period setting register; and the display controller outputting the first and second latch pulse signals respectively to the first and second data drivers, the first and second data drivers storing display data for one horizontal scan period based on the first and second latch pulse signals.

2. The display controller as defined in claim 1, further comprising:

a blanking adjustment signal generation section that generates first and second horizontal blanking adjustment signals respectively used for setting first and second horizontal blanking periods, the pulses of the first and second latch pulse signals are respectively output in the first and second horizontal blanking periods; and a grayscale clock signal generation section that generates first and second grayscale clock signals, each of the first and second grayscale clock signals having first to Nth grayscale pulses in a predetermined period, N being an integer greater than one, the second horizontal blanking adjustment signal changing earlier than the first horizontal blanking adjustment signal by a period corresponding to the phase difference set in the offset period setting register;

the display controller outputting the first horizontal blanking adjustment signal and the first grayscale clock signal to the first data driver, the first data driver driving the data lines by using a signal pulse-width-modulated based on the first horizontal blanking adjustment signal and the first grayscale clock signal; and the display controller outputting the second horizontal blanking adjustment signal and the second grayscale clock signal to the second data driver, the second data driver driving the data lines by using a signal pulse-width-modulated based on the second horizontal blanking adjustment signal and the second grayscale clock signal.

3. The display controller as defined in claim 2, further comprising:

a grayscale pulse setting register used for selling edges of the first to Nth grayscale pulses of the first grayscale clock signal, an interval between a change timing of the first horizontal blanking adjustment signal and an edge of the first grayscale pulse, and an interval between an edge of the (i−1)th grayscale pulse and an edge of the ith grayscale pulse being set based on a value set in the grayscale pulse setting register, within a predetermined period, the predetermined period starting at the change timing of the first horizontal blanking adjustment signal and ending at a next change timing of the first horizontal blanking adjustment signal, i being equal to or greater than 2, i being equal to or less than N, and i being an integer; and an interval between a change timing of the second horizontal blanking adjustment signal and an edge of the first grayscale pulse, and an interval between an edge of the (i−1)th grayscale pulse and an edge of the ith grayscale pulse are set based on a value set in the grayscale pulse setting register, within a predetermined period, the predetermined period starting at the change timing of the second horizontal blanking adjustment signal and ending at a next change timing of the second horizontal blanking adjustment signal.

4. The display controller as defined in claim 2, further comprising:

first and second horizontal blanking period setting registers, periods starting at a start timing of one horizontal scan period and ending at change timings of the first and second horizontal blanking adjustment signals being respectively set in the first and second horizontal blanking period setting registers, the blanking adjustment signal generation section changing the first horizontal blanking adjustment signal when a period corresponding to a value set in the first horizontal blanking period setting register has elapsed from the start timing; and the blanking adjustment signal generation section changing the second horizontal blanking adjustment signal when a period corresponding to a value set in the second horizontal blanking period setting register has elapsed from the start timing.

5. The display controller as defined in claim 2, the blanking adjustment signal generation section generating first and second vertical blanking adjustment signals respectively used for setting first and second vertical blanking periods, the pulses of the first and second latch pulse signals being respectively output in the first and second vertical blanking periods;

the second vertical blanking adjustment signal changing earlier than the first vertical blanking adjustment signal by a period corresponding to the phase difference set in the offset period setting register; and the display controller outputting the first and second vertical blanking adjustment signals respectively to first and second scan drivers, the first and second scan drivers driving the scan lines of the display panel, the display panel including display elements, the display elements being discharged based on the first and second horizontal blanking adjustment signals and the first and second vertical blanking adjustment signals.

6. The display controller as defined in claim 5, further comprising:

first and second vertical blanking period setting registers, periods starting at a start timing of one horizontal scan period and ending at change timings of the first and second vertical blanking adjustment signals being respectively set in the first and second vertical blanking period setting registers, the blanking adjustment signal generation section changing the first vertical blanking adjustment signal when a period corresponding to a value set in the first vertical blanking period setting register has elapsed from the start timing; and the blanking adjustment signal generation section changing the second vertical blanking adjustment signal when a period corresponding to a value set in the second vertical blanking period setting register has elapsed from the start timing.

7. The display controller as defined in claim 5, further comprising:

a vertical synchronization signal generation section that generates a vertical synchronization signal based on the number of horizontal display dots, the number of the scan lines, and an idle period set in one horizontal scan period, the vertical synchronization signal having a pulse for specifying one vertical scan period, the vertical synchronization signal being output to the first or second scan driver.

8. A display system, comprising:

a display panel that includes: a plurality of scan lines; a plurality of data lines; and a plurality of electroluminescent elements, each of the electroluminescent elements including one of the scan lines and one of the data lines;

first and second scan drivers that scan the scan lines;

first and second data drivers that drive the data lines; and the display controller as defined in claim 5, the display controller outputting the first and second horizontal blanking adjustment signals respectively to the first and second data drivers, and outputting the first and second vertical blanking adjustment signals respectively to the first and second scan drivers; and the electroluminescent elements being discharged based on the first and second horizontal blanking adjustment signals and the first and second vertical blanking adjustment signals.

9. A display system, comprising:

a display panel that includes: a plurality of scan lines; a plurality of data lines; and a plurality of electroluminescent elements, each of the electroluminescent elements including one of the scan lines and one of the data lines;

a scan driver that scans the scan lines;

first and second data drivers that drive the data lines; and the display controller as defined in claim 1, the display controller outputting the first and second latch pulse signals respectively to the first and second data drivers, the first and second data drivers storing the display data for one horizontal scan period based on the first and second latch pulse signals.

10. A display control method that controls first and second data drivers driving a plurality of data lines of a display panel, the display panel including a plurality of scan lines in addition to the data lines, and the display control method comprising:

generating first and second latch pulse signals having pulses, the pulses specifying one horizontal scan period, the second latch pulse signal changing earlier than the first latch pulse signal by a period corresponding to a phase difference between the first and second latch pulse signals, the phase difference being set in an offset period setting register; and outputting the first and second latch pulse signals respectively to the first and second data drivers, the first and second data drivers storing display data for one horizontal scan period based on the first and second latch pulse signals.

11. The display control method as defined in claim 10, further comprising:

generating a second horizontal blanking adjustment signal, the second horizontal blanking adjustment signal changing earlier than a first horizontal blanking adjustment signal by a period corresponding to the phase difference set in the offset period setting register, the first horizontal blanking adjustment signal being used for setting a first horizontal blanking period, the pulse of the first latch pulse signal being output in first horizontal blanking period, and the second horizontal blanking adjustment signal being used for setting a second horizontal blanking period, the pulse of the second latch pulse signal being output in the second horizontal blanking period;

outputting the first horizontal blanking adjustment signal and a first grayscale clock signal to the first data driver, first data driver driving the data lines by using a signal pulse-width-modulated based on the first horizontal blanking adjustment signal and the first grayscale clock signal, the first grayscale clock signal having first to Nth grayscale pulses in a predetermined period, N being an integer greater than one; and outputting the second horizontal blanking adjustment signal and a second grayscale clock signal to the second data driver, the second data driver driving the data lines by using a signal pulse-width-modulated based on the second horizontal blanking adjustment signal and the second grayscale clock signal, the second grayscale clock signal having first to Nth grayscale pulses in a predetermined period.

* * * * *